US006077146A

United States Patent [19]

Sato et al.

[11] Patent Number: 6,077,146

[45] Date of Patent: Jun. 20, 2000

[54] METHOD OF CORRECTING A TAPER IN A GRINDING MACHINE, AND APPARATUS FOR THE SAME

[75] Inventors: Masayuki Sato; Hisao Sasaki; Yoshiharu Oyabe, all of Toyama, Japan

[73] Assignee: Nippei Toyama Corporation, Tokyo, Japan

[21] Appl. No.: 09/164,589

[22] Filed: Oct. 1, 1998

[30] Foreign Application Priority Data

Oct. 1, 1997 [JP] Japan ..... 9-284717
Dec. 26, 1997 [JP] Japan ..... 9-361578

[51] Int. Cl.[7] ..... B24B 49/00; B24B 51/00

[52] U.S. Cl. ..... 451/5; 451/8; 451/9; 451/121; 451/243; 451/251

[58] Field of Search ..... 451/5, 8, 243, 451/9, 242, 10, 251, 11, 252, 28, 253, 41, 121, 142

[56] References Cited

U.S. PATENT DOCUMENTS

| | | | |
|---|---|---|---|
| 3,660,947 | 5/1972 | Clark, Jr. | 451/142 |
| 3,690,072 | 9/1972 | Price | 451/9 |
| 4,094,105 | 6/1978 | Hatanaka et al. | 451/251 |
| 4,945,683 | 8/1990 | Phillips | 451/251 |

*Primary Examiner*—Derris H. Banks

*Attorney, Agent, or Firm*—Sughrue, Mion, Zinn, Macpeak & Seas, PLLC

[57] ABSTRACT

A taper correcting apparatus for a grinding machine comprises: workpiece supporting means for supporting a workpiece in parallel with a grinding wheel spindle; a cutting and feeding device which moves back and forth a cylindrical grinding wheel with respect to said workpiece; a wheel slide which is attached to a bed so as to be movable back and forth with respect to said workpiece; a pair of grinding wheel bearing pedestals which rotatably support ends of said grinding wheel spindle via bearings with respect to said wheel slide, respectively; a first grinding wheel bearing pedestal support which is fixed to said wheel slide, and which clampingly supports one of said grinding wheel bearing pedestals; a second grinding wheel bearing pedestal support which is attached so as to be rotatable about a round shaft, and which clampingly supports another one of said grinding wheel bearing pedestals, said round shaft being attached below said grinding wheel spindle to said wheel slide in parallel with the center line of said workpiece; a pressurring device which presses said second grinding wheel bearing pedestal support to rotate said second grinding wheel bearing pedestal support about said round shaft, thereby changing a distance between a center of said grinding wheel spindle and a center of said workpiece; and controlling means for controlling a pressing amount of said pressurring device, so that parallelism between a center line of said workpiece and a center line of said grinding wheel spindle is corrected.

20 Claims, 17 Drawing Sheets

METHOD OF CORRECTING A TAPER IN A GRINDING MACHINE, AND APPARATUS FOR THE SAME

BACKGROUND OF THE INVENTION

The present invention relates to a method of correcting a taper in a grinding machine and a taper correcting apparatus for the same.

Conventionally, a cylindrical grinding machine is provided with a parallelism correcting apparatus in order to correct parallelism between a center line connecting a tail stock defining the center of a workpiece and a head stock defining the center of a workpiece and a center line of a grinding wheel spindle.

For example, U.S. Pat. No. 3,690,072 discloses a structure in which grinding wheel bearings are supported by an eccentric housing, and a grinding wheel spindle can be tilted by rotating the housing.

Unexamined Japanese Patent Application Publication No. Hei. 3-281156 discloses a structure in which an elastic flexible portion is disposed in a grinding wheel spindle housing which holds grinding wheel bearings, and the grinding wheel housing can be tilted about the elastic flexible portion by a toggle mechanism.

Unexamined Japanese Patent Application Publication No. Hei. 7-195266 discloses a structure in which a table on which a head stock and a tail stock are mounted can be displaced in a horizontal plane.

Generally, in a grinding machine which grinds a workpiece having an untrue circular shape, such as a crank shaft or a cam shaft, the workpiece is rotated while one end of the workpiece is supported by a tail stock on a workpiece spindle stock and the other end is clamped by a workpiece chuck of a workpiece spindle. The rotation axis of the workpiece is made parallel with the rotation axis of plural grinding wheels disposed on a wheel spindle stock, and the grinding wheels are moved back and forth in a grinding direction or in a direction perpendicular to the rotation axis of the workpiece. An inclination of the rotation axis of the grinding wheels with respect to the rotation axis of the workpiece is adjusted on the basis of data of outer diameters of ground surfaces of end portions of the workpiece which are measured by plural sizing devices during a work of grinding the workpiece, thereby reducing a taper of the outer circumferential face of the workpiece to "zero," i.e., making the outer diameters of ground surfaces of end portions of the workpiece equal to each other.

In a process of designing such a grinding machine, the rotation axis of a workpiece rotated while being supported by the workpiece supporting mechanism is set to be parallel with the rotation axis of the grinding wheels supported by the wheel spindle stock, and the plural grinding wheels are set to have the same diameter. When a workpiece is ground, however, the outer diameters of ground surfaces of end portions of the workpiece are often different from each other because of production errors of components of the grinding machine and assembly errors, with the result that the ground surface of the workpiece is tapered.

In an initial stage of operation where a work grinding work by a grinding machine is started, particularly, the temperature of the grinding machine is gradually raised, and the temperature change causes components constituting the grinding machine to thermally expand in different manners. As a result, even when workpieces are ground under the same conditions, a difference between outer diameters of ground surfaces of end portions of each workpiece, i.e., the taper accuracy of each workpiece is largely changed. In an initial stage of operation, for example, first to fifth workpiece grinding works, the inclination of the rotation axis of the grinding wheels with respect to the rotation axis of the workpiece which is required for correcting a taper of a workpiece is largely changed. Conventionally, the taper correction is not performed at all during a period from a timing when the grinding wheels are moved from their standby position to that immediately before the grinding wheels are contacted with the ground surface of the workpiece. After the work of grinding the workpiece by the grinding wheels is started, the taper correction is performed by feedback controlling a servomotor of a taper correcting apparatus on the basis of data of outer diameters of end portions of the workpiece which are measured by sizing devices.

In a grinding machine, plural rest devices are disposed at positions which are opposed to the grinding wheels, respectively, in order to prevent the workpiece from being pressed during a grinding work by the grinding wheels at a degree in excess of that needed. Following to a change of the grinding amount, advance positions of the rest devices which are contacted with the workpiece, or the pressing forces of the rest devices exerted on the ground surface of the workpiece are controlled.

In the above-described taper correction, a method of correcting a taper of a workpiece in an initial stage of operation of a grinding machine is performed after a grinding wheel is contacted with a ground surface of the workpiece. Therefore, the method has a problem in that the time period required for the taper correction is long and hence the time period of grinding a workpiece cannot be shortened. The reason of the above will be described.

Referring to FIG. 22 which schematically shows an apparatus for correcting a taper of a workpiece, an inclination of a rotation axis O2 of grinding wheels 91, 92, and 93 with respect to a rotation axis O1 of a workpiece W and about a fulcrum O is adjusted by a motor M1. In the adjustment of the inclination, the state where the rotation axes O1 and O2 are parallel with each other is set as a reference position, and the rotation axis is moved in the same direction as that in which the grinding wheels 91, 92, and 93 are advanced by a motor M2 and which is perpendicular to the rotation axis O1 of the workpiece W. When the direction of the taper correction is identical with the grinding direction, a correction point P1 of the rotation axis O2 of the grinding wheels 91, 92, and 93 is subjected to a correction to the minus side in which the cutting amount of the workpiece W is increased and the reduction of the outer diameter of the right-end pin portion W3 of the workpiece W is larger than that of the outer diameter of the left-end pin portion W1. When the directions are opposite to each other, a correction to the plus side is performed in which the reduction of the outer diameter of the right-end pin portion W3 of the workpiece is smaller than that of the outer diameter of the left-end pin portion W1. In the case where only the taper correction to the plus side is to be performed, even when the taper correction is performed during a grinding work, it is not required to reduce the advancing speed of the grinding wheels by the motor M2. Therefore, the time period of grinding is not prolonged. When the workpiece is ground while performing the taper correction to the plus side, however, phenomena such as increase of distortion of the workpiece and impairment of the surface roughness occur. As a result, actually, both the advancing speed of the grinding wheels and that of the taper correction are reduced. By contrast, the correction to the minus side must be performed during a grinding work while the operation of advancing the grinding wheels is stopped. In this case, therefore, there arises a problem in that the time period of a grinding work is further prolonged as the taper correction amount is larger.

These problems are conspicuous in an initial stage of operation of a grinding machine, but occur also in the steady operation. A steady operation region where the grinding work by a grinding machine has been performed a predetermined number of times and mechanisms of the grinding machine stably operate is a stable region where the amount of each taper correction in works of the same kind is reduced and the amount of the taper correction in each of works is not substantially changed. However, the taper correction is performed during a grinding work, and hence the time period of the grinding work is prolonged by the correction.

In consideration of the above, a configuration in which the taper corrections to the plus and minus sides on a correction point of a workpiece is not entirely performed or, even when such a correction is performed, the correction amount is very small is ideal for shortening the time period of a grinding work, reducing distortion of a ground surface of a workpiece, and improving the accuracy such as distortion of a ground surface of the workpiece and the surface roughness.

On the other hand, the rest devices are advanced and retracted by a servomotor, and perform only positioning. Alternatively, rapid advancement and retraction are performed by means of positioning, and other operations are controlled by means of a torque. Thereafter, the apparatus for correcting a taper of a workpiece is operated so as to correct a difference between outer diameters of ground surfaces of end portions of a workpiece, i.e., a taper. During this correction, conventionally, the advance positions of the rest devices which delicately affect the difference between outer diameters, and the pressing force on the ground surface are not corrected. In a grinding machine in which the taper correction amount of a workpiece is largely changed, therefore, a failure in the advance position of a rest device or in a pressing force causes the function of the workpiece for supporting the ground surface, to be excessively increased or deficiently reduced, thereby producing a problem in that the accuracies of the workpiece such as the roundness and the straightness are unstable.

SUMMARY OF THE INVENTION

It is an object of the invention to provide a taper correcting apparatus for a grinding machine which can accurately execute a correction operation of correcting a taper formed in a workpiece, without forming a gap or creep in the apparatus.

A second object of the invention is to provide a method of correcting a taper in a grinding machine, and an apparatus for the same which can rapidly correct a taper of a workpiece to improve the efficiency of grinding of a workpiece.

A third object of the invention is to provide a method of correcting a taper in a grinding machine, and an apparatus for the same which can attain the second object and further improve accuracies of a workpiece such as the roundness and the straightness by improving a function of a rest device for supporting the ground surface of a workpiece.

A fourth object of the invention is to provide a method of correcting a taper in a grinding machine, and an apparatus for the same which can attain the second and third objects and further improve the taper accuracy of a workpiece.

According to a first apsect of the invention, there is provided a taper correcting apparatus for a grinding machine comprising: workpiece supporting means for supporting a workpiece in parallel with a grinding wheel spindle; and a cutting and feeding device which moves back and forth a cylindrical grinding wheel with respect to the workpiece, the machine correcting parallelism between a center line of the workpiece and a center line of the grinding wheel spindle, wherein the taper correcting apparatus comprises: a wheel slide which is attached to a bed so as to be movable back and forth with respect to the workpiece; a pair of grinding wheel bearing pedestals which rotatably support ends of the grinding wheel spindle via bearings with respect to the wheel slide, respectively; a first grinding wheel bearing pedestal support which is fixed to the wheel slide, and which clampingly supports one of the grinding wheel bearing pedestals; a second grinding wheel bearing pedestal support which is attached so as to be rotatable about a round shaft, and which clampingly supports another one of the grinding wheel bearing pedestals, the round shaft being attached below the grinding wheel spindle to the wheel slide in parallel with the center line of the workpiece; a pressurring device which presses the second grinding wheel bearing pedestal support to rotate the second grinding wheel bearing pedestal support about the round shaft, thereby changing a distance between a center of the grinding wheel spindle and a center of the workpiece; and controlling means for controlling a pressing amount of the pressurring device, so that paralleism between a center line of the workipiece and a center line of the grinding wheel spindle is corrected.

According to a second aspect of the invention, in the taper correcting apparatus of the first aspect, the pressurring device is an eccentric shaft device comprising: an eccentric shaft which is coupled to an output portion of a reduction gear with setting a center of the eccentric shaft to be eccentric, an input shaft of the reduction gear being coupled to a servomotor; a ring which is rotatably fitted onto an outer circumference of the eccentric shaft; an engaging hole which is formed in an outer circumference of the ring; a bracket portion which is disposed on the second grinding wheel bearing pedestal support, and which has an abutting portion that is to abut against the outer circumference of the ring, the bracket portion elongating in a lateral direction with respect to a line connecting a center of the round shaft and a center of a grinding wheel bearing; an engaging pin which protrudes from the abutting portion, and which is engaged with the engaging hole in the outer circumference of the ring; and a pressing member which passes through the bracket portion via a spring member to be fixed to the wheel slide, and which presses the bracket portion by means of the spring member so that the abutting portion of the bracket portion is always pressingly contacted with the outer circumference of the ring.

According to a third aspect of the invention, in the taper correcting apparatus of either first or second aspect, the bearings have a bearing gap which allows the grinding wheel spindle to be tilted in a predetermined range.

According to a fourth aspect of the invention, there is proivded a method of correcting a taper in a grinding machine in which a grinding wheel disposed on a wheel spindle stock moves back and forth in a direction perpendicular to a rotation axis of a workpiece which is grasped at both ends by a workpiece supporting mechanism, while making the rotation axis of the workpiece substantially parallel with a rotation axis of said grinding wheel, and an inclination of the rotation axis of the grinding wheel with respect to the rotation axis of the workpiece is corrected on the basis of outer diameters of ground surfaces of end portions of the workpiece, the outer diameters being measured by at least two sizing devices during a work of grinding the workpiece, thereby reducing a taper of a ground surface of the workpiece to "zero," the method comprising the steps of: increasing or decreasing a taper correction amount required for grinding of the workpiece by means of the grinding wheel on the basis of a taper correction amount retrieved from a database which is previously stored; then, starting the work of grinding the workpiece; and correcting the inclination of the rotation axis of the grinding wheel on the basis of outer diameters, measured by the sizing devices, of the ground surfaces of the end portions of the workpiece, so as to reduce a taper of the ground surface of the workpiece to "zero."

According to a fifth aspect of the invnetion, the method of the fourth apsect, further comprises: (a) performing a test grinding work on plural workpieces, and storing amounts of taper correction on ground surfaces of the workpieces, together with workpiece data including kinds and sizes of the workpieces, and grind condition data of the test grinding works, as the database; (b) retrieving grind condition data corresponding to workpiece data of a workpiece which is to be newly ground, from the database, and setting a taper correction amount which is stored in correspondence with the retrieved data, as a taper correction amount of the workpiece which is to be newly ground; and (c), during a period when the grinding wheel is moved from a standby position to be contacted with the workpiece and the grinding work is started, adjusting the inclination of the rotation axis of the grinding wheel to a predetermined value, by using the taper correction amount which is set in the step (b).

According to a sixth aspect of the invention, in the step (a) of the fifth aspect, the test grinding work is performed on plural workpieces in an initial stage of operation of a start of a grinding work in which a taper correction amount of a ground surface of a workpiece is relatively large, and, in the step (b), the retrieval of grind condition data corresponding to workpiece data of a workpiece which is to be newly ground is performed in an initial stage of operation of the grinding machine for a next work.

According to a seventh aspect of the invention, in the method of the sixth aspect, following to the adjustment of the inclination of the rotation axis of the grinding wheel, starting points of support of a workpiece of plural rest devices which oppose pressing forces of the plural grinding wheels acting on plural ground surfaces of the workpiece are adjusted.

Alternatively, according to an eighth aspect of the invention, in the method of the sixth aspect, following to the adjustment of the inclination of the rotation axis of the grinding wheel, pressing forces on a ground surface of a workpiece and exerted by plural rest devices which oppose pressing forces of the plural grinding wheels acting on the ground surface of the workpiece are adjusted.

According to a ninth aspect of the invention, in the step (a) of either one of the sixth to eighth aspects, on the basis of plural workpiece data and taper correction amounts corresponding to the workpiece data, calculation data for calculating a taper correction amount of a workpiece which similarly corresponds to the workpiece data are stored in the database, and, in the step (b), when there is no workpiece data of the workpiece which is to be newly ground, a taper correction amount of the workpiece which is to be newly ground is calculated on the basis of the calculation data and then set.

Alternatively, according to a tenth aspect of the invention, in the step (a) of either one of the sixth to eighth aspects, a number of grinding works is stored as the database, and, in the step (b), a taper correction amount of a number of works which correspond to a number of grinding works of the workpiece which is to be newly ground is retrieved from the database, and the retrieved taper correction amount is set as a taper correction amount of the workpiece which is to be newly ground.

Alternatively, according to an eleventh aspect of the invention, in the method of either one of the sixth to eighth aspects, ambient temperatures during works of grinding plural workpieces of the same kind are sampled, a correction coefficient of a taper correction amount in the case of a temperature change is calculated for plural workpieces of the same kind and then stored in the database, and, when a taper correction amount of the workpiece which is to be newly ground is to be set, an ambient temperature during a grinding work of the workpiece which is to be newly ground is compared with the stored ambient temperature and a taper correction amount of the workpiece is correctively calculated with using the correction value at the temperature.

Alternatively, according to a twelveth aspect of the invention, in the method of either one of the sixth to eighth aspects, the taper correction value of a workpiece during a grinding work is stored in the database with previously performing a test grinding work for each kind of workpieces, so that a difference between outer diameters of ground surfaces of end portions of a workpiece after end of a grinding work and at ordinary temperature becomes "zero," a taper correction value in a grinding work corresponding to a workpiece which is to be newly ground is retrieved from the database, and the test grinding work in the step (a) is performed on the basis of the taper correction value.

According to a thirteenth aspect of the invention, in place of the operation of performing the test grinding work in the step (a) on the basis of the taper correction value of the twelveth aspect, a taper correction amount of the workpiece is correctively calculated on the basis of the taper correction value.

According to a fourteenth aspect of the invention, in the method of the twelveth aspect, allowable ranges of a taper correction amount for each of steps of coarse grinding, intermediate grinding, and fine grinding are reduced stepwise around the taper correction value of a workpiece as a center.

According to a fifteenth aspect of the invention, in the method of the fourteenth aspect, during each of the steps of coarse grinding, intermediate grinding, and fine grinding, a taper correction is not performed in an initial stage, and a taper correction is performed in a final stage.

According to a sixteenth aspect of the invention, in a grinding machine comprising: a work supporting mechanism which rotates a workpiece while grasping both ends of the workpiece by a spindle on a head stock and a tail stock disposed on a work table; a wheel spindle stock having a grinding wheel which is rotatingly contacted with a ground surface of the workpiece to grind the ground surface; inclination adjusting means, disposed between the wheel spindle stock and the grinding wheel, for adjusting an inclination of a rotation axis of the grinding wheel with respect to a rotation axis of the workpiece in accordance with a taper correction amount of an outer circumference of the workpiece; wheel spindle stock driving means for moving back and forth the wheel spindle stock together with the grinding wheel with respect to the workpiece; and at least two sizing devices which measure outer diameters of ground surfaces of end portions of the workpiece, a taper correcting apparatus comprises: storage means for storing, as a database, workpiece data including kinds, lengths, weights, materials, and hardnesses of plural workpieces, grind condition data including rotational speeds and feeding speeds of the grinding wheel and corresponding to the workpiece data, and taper correction amounts of outer circumferential faces of the workpieces and corresponding to the workpiece data and the grind condition data, the workpiece data, the grind condition data, and the taper correction amounts being obtained as a result of grinding the plural workpieces by the grinding machine; retrieving means for retrieving a workpiece data, a grind condition data, and a taper correction amount corresponding to a workpiece which is to be newly ground, from the database; and controlling means for controlling operations of the inclination adjusting means and the wheel spindle stock driving means on the basis of the grind condition data and the taper correction amount.

According to a seventeenth aspect of the invention, in the taper correcting apparatus of the sixteenth aspect, the storage means stores workpiece data, grind condition data, and taper correction amounts of ground surfaces of plural workpieces and corresponding to the workpiece data and the grind condition data, the grind condition data, and the taper correction amounts being obtained as result of grinding the workpieces in an initial stage of an operation of the grinding machine, and the retrieving means retrieves a workpiece data, a grind condition data, and a taper correction amount corresponding to a workpiece which is to be newly ground, from the database, in an initial stage of an operation of the grinding machine for a next work.

According to an eighteenth sapect of the invention, in the taper correcting apparatus of the seventeenth aspect, the grinding machine further comprises: plural rest devices which support a ground surface of the workpiece when the workpiece is ground by the grinding wheel; and rest device driving means for moving the rest devices in accordance with a grinding amount of the workpiece, and, following to a change of the taper correction amount, the controlling means adjusts advance positions of the rest devices, and adjusts pressing forces of the rest devices exerted on the workpiece.

According to a ninteenth aspect of the invention, in the taper correcting apparatus of either seventeenth or eighteenth aspect, the grinding machine comprises number detecting means for detecting a number of works of grinding a workpiece, and, on the basis of number data from the number detecting means, the retrieving means retrieves corresponding a grind condition data and a taper correction amount from the database.

According to a twenty aspect of the invention, in the taper correcting apparatus of the ninteenth aspect, the grinding machine further comprises temperature detecting means for detecting a room temperature of an ambient, or a temperature of a vicinity of the wheel spindle stock of the grinding machine, and the controlling means comprises means for calculating a taper correction amount on the basis of temperature data from the temperature detecting means.

DETAILED DESCRIPTION OF PREFERRED EMBODIMENTS

Hereinafter, a first embodiment of the invention will be described with reference to the accompanying drawings.

The invention will be described with reference to FIGS. 1 to 7. First, the whole configuration of an apparatus will be described with reference to FIGS. 1 to 3, and then main portions of the invention will be described with reference to FIGS. 4 to 7.

Figure 1:
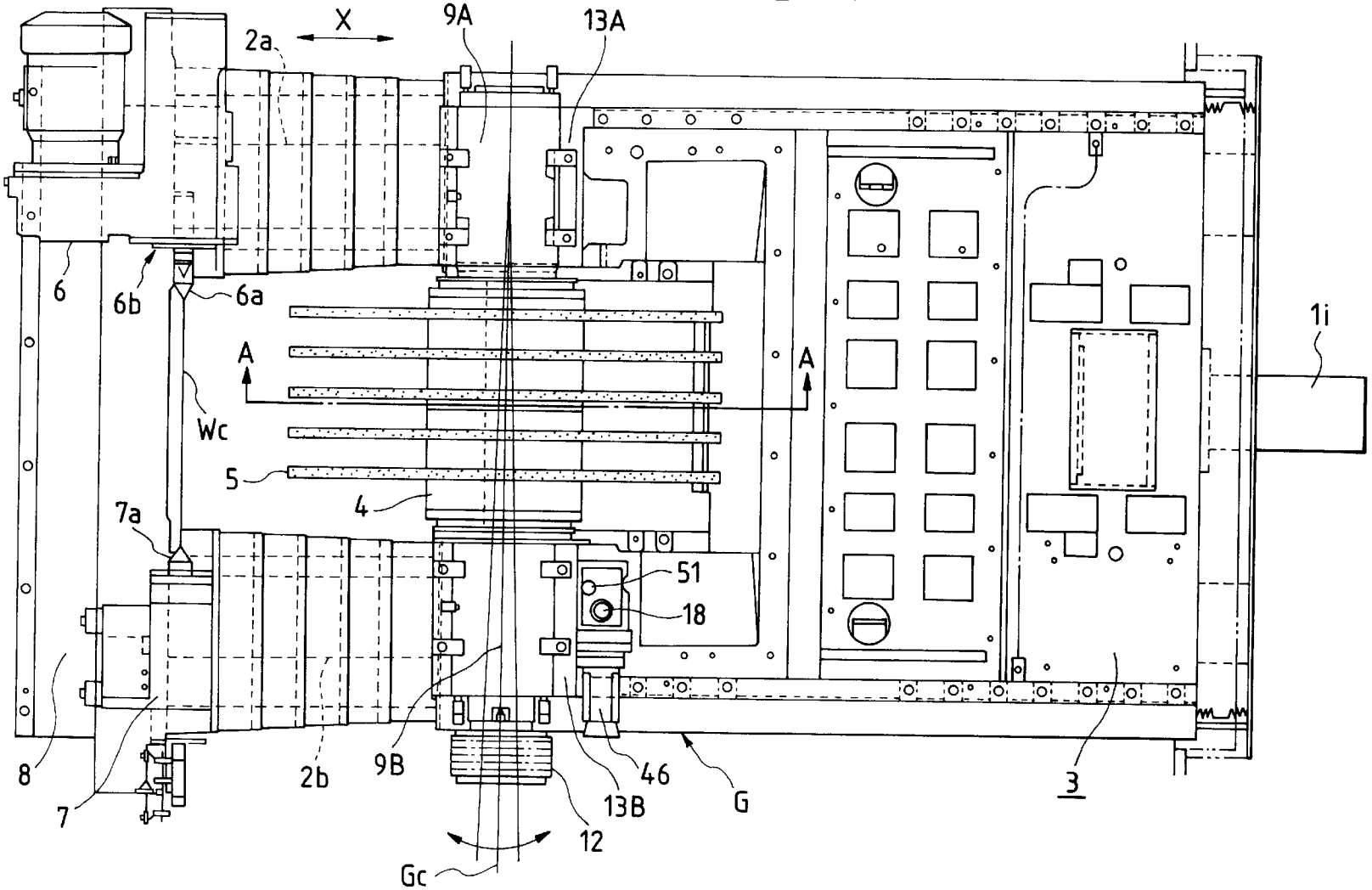
FIG. 1 is a plan view of a grinding machine according to a first embodiment of the invention.
Figure 2:
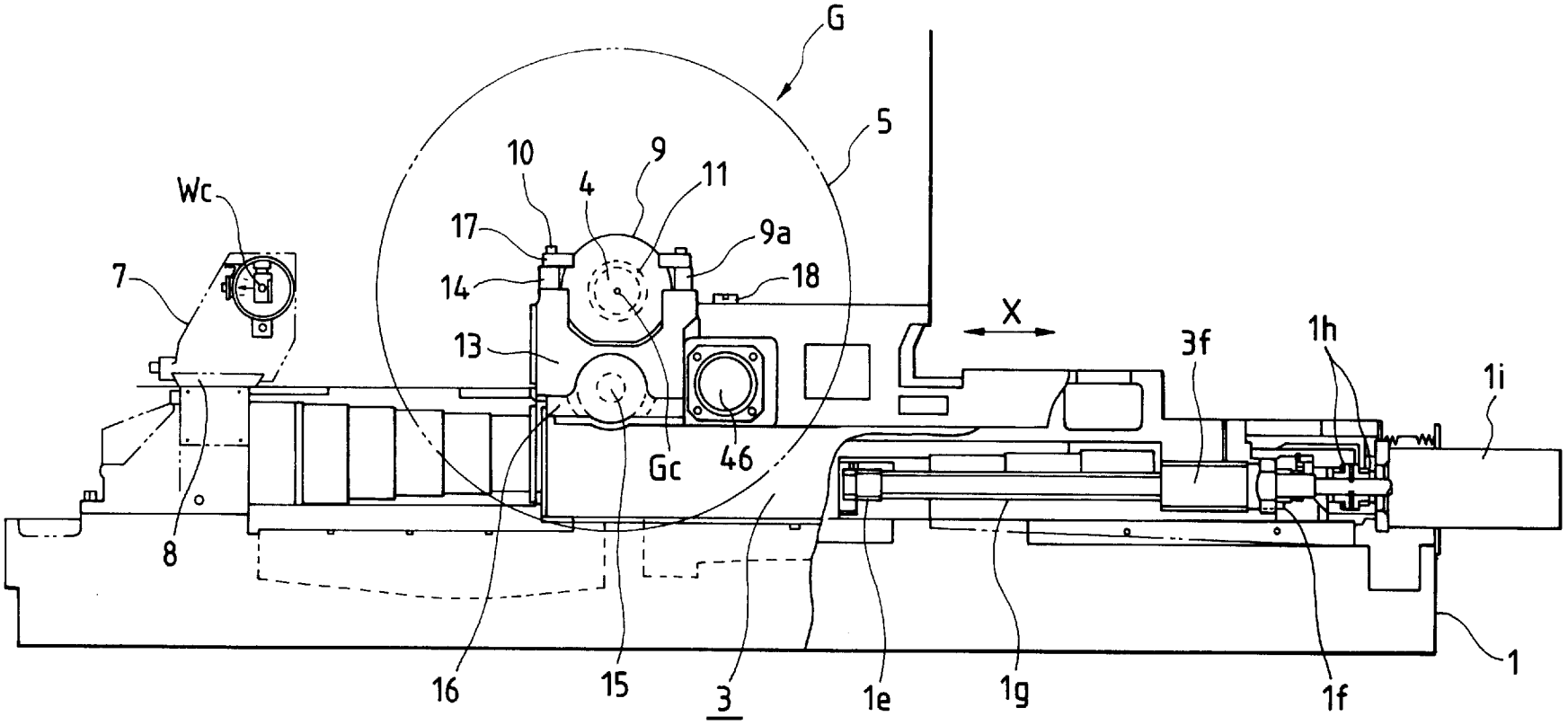
FIG. 2 is a side view showing the grinding machine of FIG. 1, in partial section.

In a grinding machine G, as shown in FIGS. 1 and 2, a head stock 6, and a tail stock 7 supporting a workpiece (not shown) are mounted on a base 8 fixed to a bed 1 so that the positions of the stocks are adjustable in the axial direction. The head stock 6 and the tail stock 7 have centers 6*a* and 7*a*, respectively, so as to support the workpiece. The center 6*a* is fittingly attached to a rotating workpiece spindle 6*b*. A driving member (not shown) such as a chuck or KERE which transmits rotation to the workpiece is attached to the workpiece spindle 6*b*. A wheel slide 3 is disposed on the bed 1 so as to be reciprocally movable along two slide bars 2*a* and 2*b* which are fixed to the bed 1 in a direction (X direction) perpendicular to a workpiece center line Wc connecting the centers 6*a* and 7*a*. A grinding wheel spindle 4 is supported on the wheel slide 3 in parallel with the workpiece center line Wc. A large number (in the embodiment, five) of cylindrical grinding wheels 5 are disposed at intervals on the grinding wheel spindle 4.

The ends of the grinding wheel spindle 4 are rotatably supported by bearings 11A and 11B fixed to grinding wheel bearing pedestals 9A and 9B, respectively. The bearing 11A supports the end portion of a stationary side of the grinding wheel spindle 4, and the bearing 11B supports the end portion of an adjusting side of the grinding wheel spindle 4. For example, the bearings 11A and 11B are static pressure bearings, and a bearing gap is formed between the grinding wheel spindle 4 and each of the bearings. A pulley 12 which is fixed to the grinding wheel spindle 4 as shown in FIG. 1 is coupled via a V-belt with a pulley attached to an electric motor (not shown) mounted on the wheel slide 3.

Figure 3:
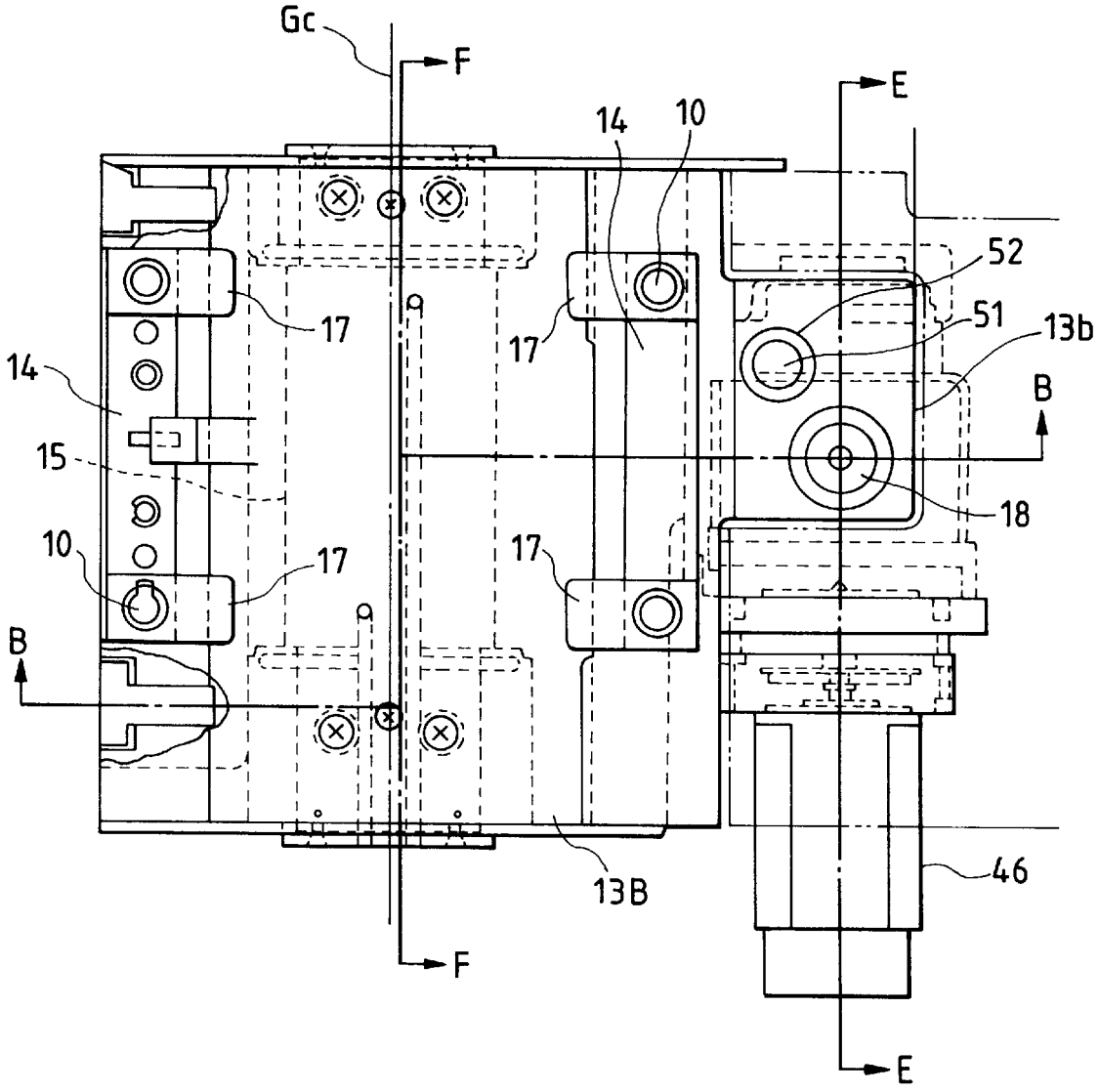
FIG. 3 is an enlarged plan view of a bearing of one side in FIG. 1.
Figure 4:
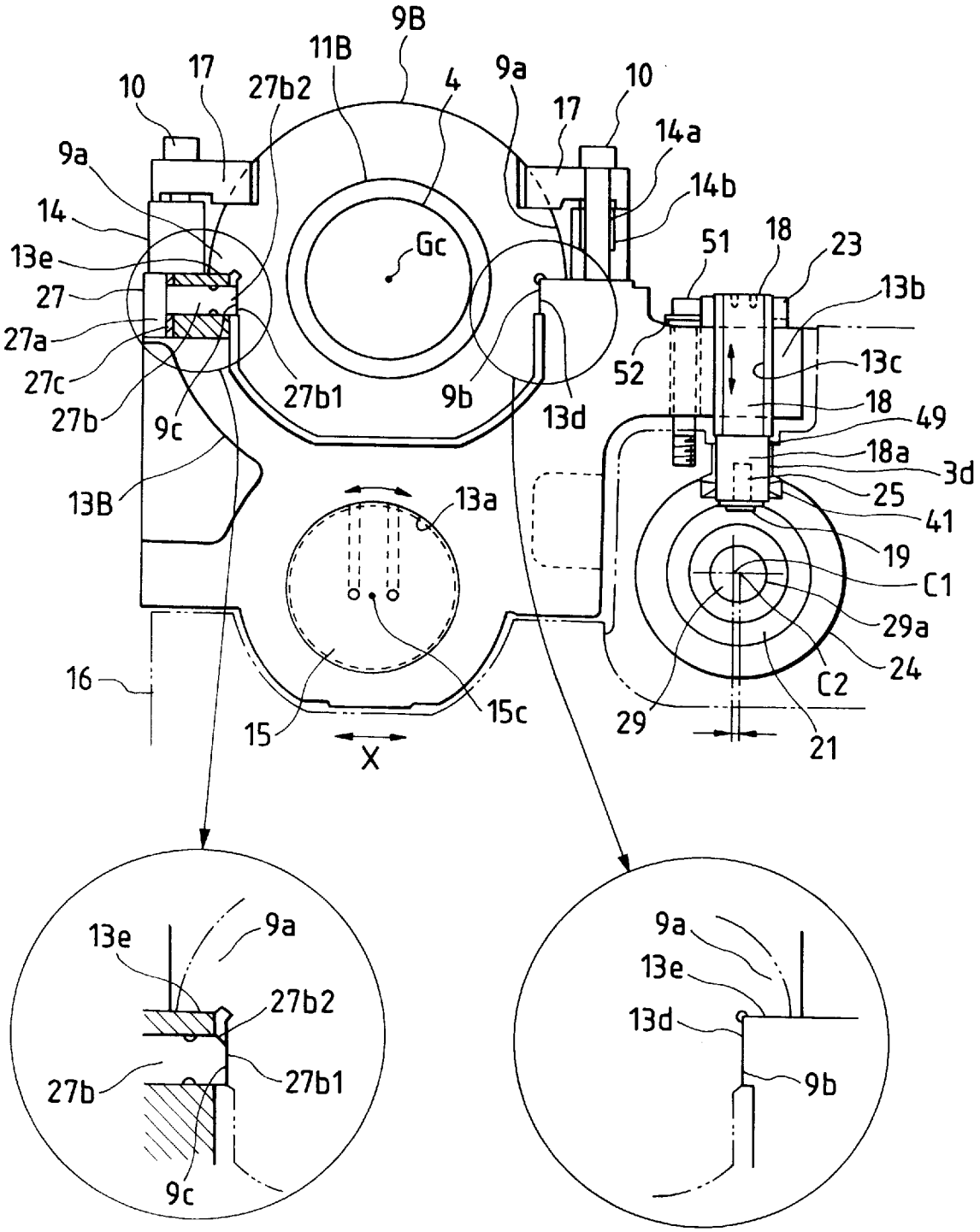
FIG. 4 is a section view taken along the line B—B of FIG. 3.
Figure 7:
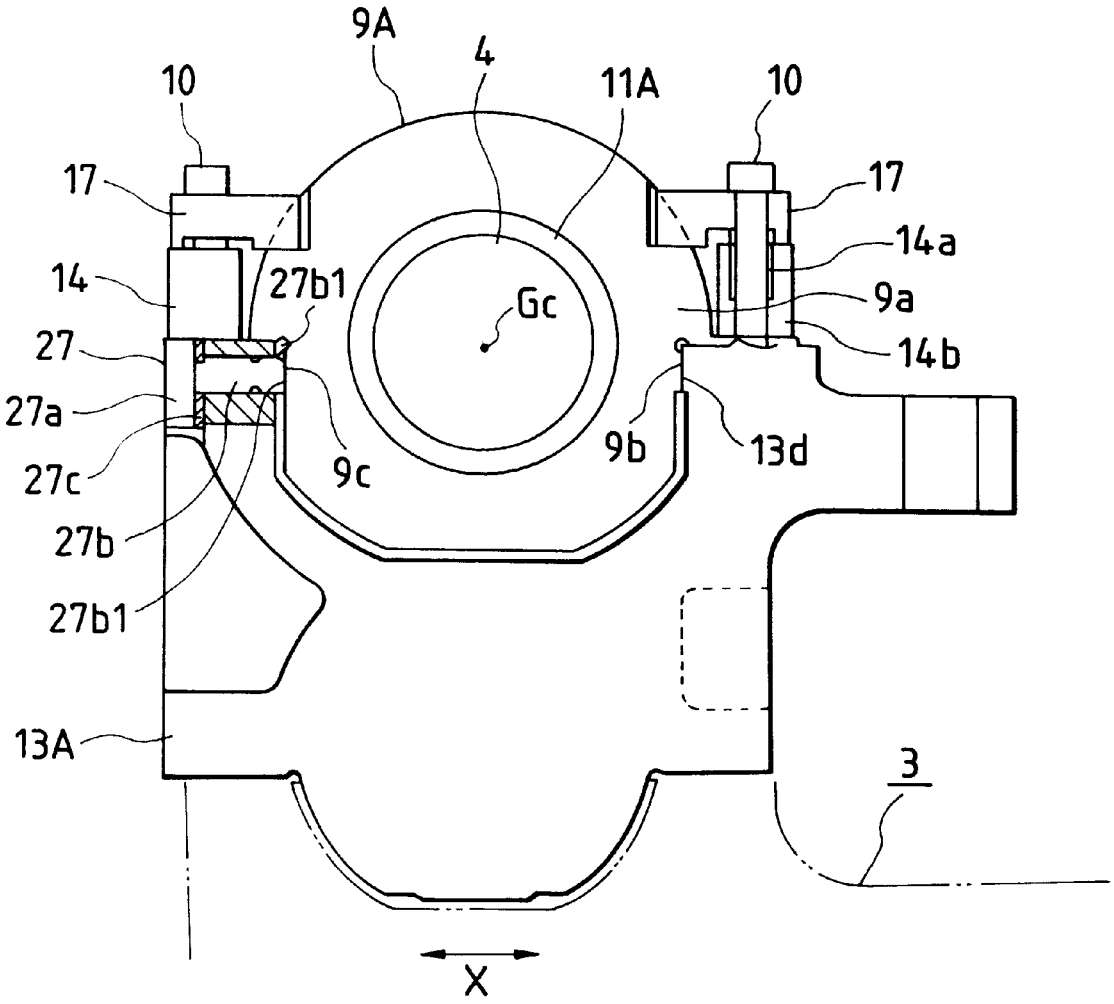
FIG. 7 is a side view of a grinding wheel bearing of a stationary side.

As shown in FIGS. 3, 4, and 7, the grinding wheel bearing pedestals 9A and 9B on the both sides are clampingly supported by grinding wheel bearing pedestal supports 13A and 13B, respectively. The clamping of the grinding wheel bearing pedestals 9A and 9B to the grinding wheel bearing pedestal supports 13A and 13B is performed in the following manner. A flange 9*a* is formed in the lateral ends of each of the grinding wheel bearing pedestals 9A and 9B. In each of the flanges 9*a*, the lower face portions of the both sides are engaged with shoulders 13*e* disposed on the corresponding grinding wheel bearing pedestal support 13A or 13B, the upper face portions are pressed by pressing members 17 formed on liners 14 which fixedly upstand from the grinding wheel bearing pedestal support 13A or 13B, thereby attaining the clamping. Each pressing member 17 is rotatably attached by one bolt 10 which passes through the pressing member 17 and the corresponding liner 14 and is then screwed into the grinding wheel bearing pedestal support 13A or 13B. Each of the pressing members 17 is configured so that, when the pedestals are to be clamped, the pressing member 17 is opposed to the upper face of the flange 9*a* of the grinding wheel bearing pedestal 9A or 9B, and, when the pedestals are to be unclamped, the pressing member is retracted.

Each of the pressing members 17 has a shape of a narrow block. As shown in FIGS. 4 and 7, in a clamping state, one end of the pressing member is contacted with the liner 14 and the other end is contacted with the grinding wheel bearing pedestal 9A or 9B to press the pedestal. At the middle portion where the bolt 10 passes through a bolt hole of the pressing member 17 with forming a clearance therebetween, a gap is formed between the pressing member 17 and the corresponding liner 14. A spring member 14*a* such as a compression coil spring is housed in a spring housing hole 14*b* which is formed by increasing the diameter of the bolt hole of the liner 14. The pressing member 17 is urged by the spring member 14*a* in an upward direction, i.e., the clamping direction. The bolt 10 passes through the spring member 14*a*. In a state where the pressing members 17 are tightened by the bolts 10 against the spring forces of the spring members 14*a*, the pressing members 17 clamp the grinding wheel bearing pedestals 9A and 9B in the vertical direction. In the grinding wheel bearing pedestal supports 13A and 13B of the both sides, the pressing members 17 are arranged in the same manner. In each of the stationary and adjusting sides, as shown in FIG. 3 indicating the grinding wheel bearing pedestal support 13B of the adjusting side, the liners 14 are parallel with each other and each of the liners is formed by a single rod member. The pressing members 17 are disposed at both the end portions of each liner 14, respectively.

Figure 6:
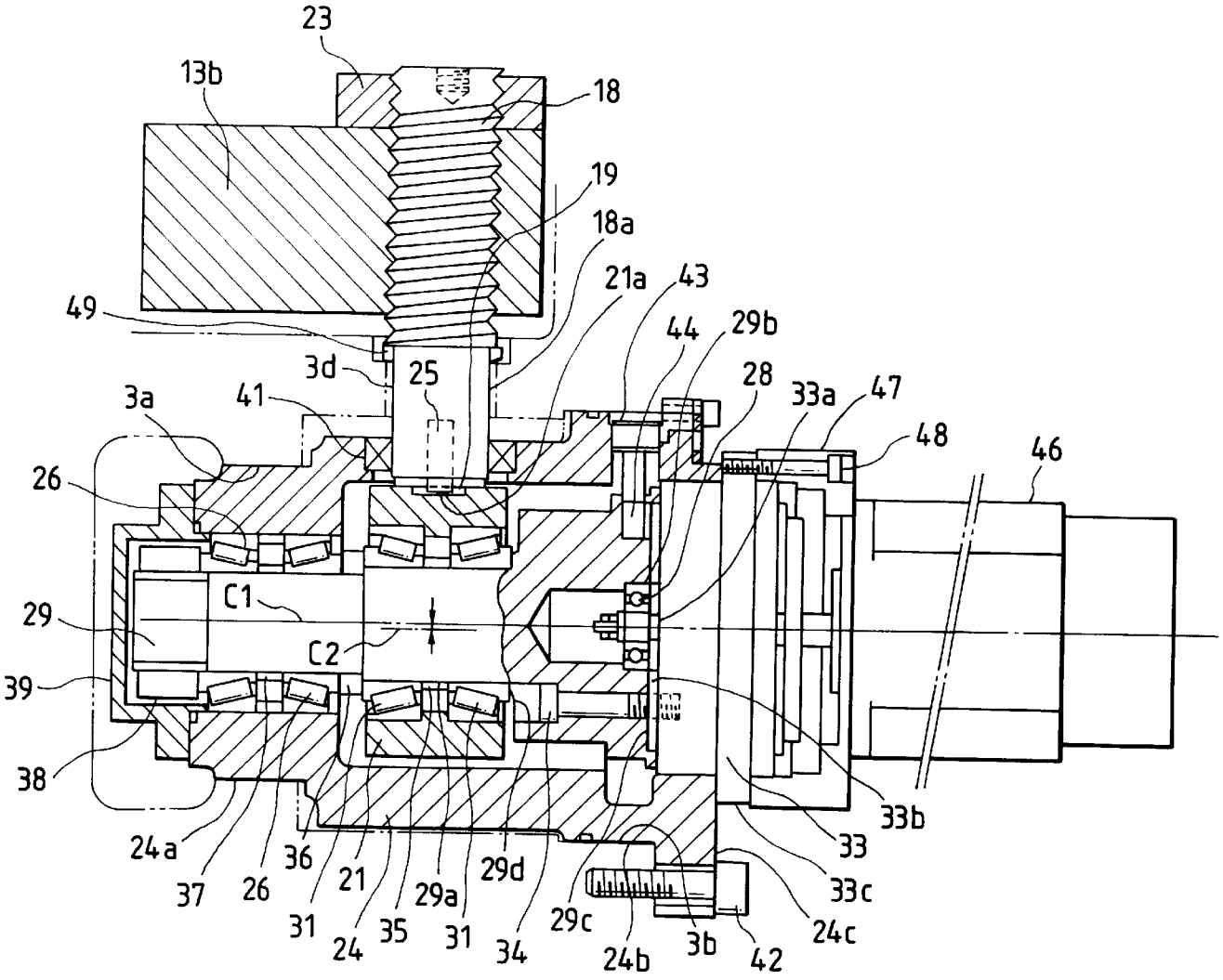
FIG. 6 is a section view taken along the line E—E of FIG. 3.

As shown in FIG. 6, the first bearing pedestal support 13A supporting the bearing pedestal 9A to which the bearing 11A of the stationary side is secured is fixed to the wheel slide 3 by bolts (not shown). The second bearing pedestal support 13B supporting the bearing pedestal 9B to which the bearing 11B of the adjusting side is fixed is supported so as to be swingable about a shaft which is parallel with the bearing 11B, as described later.

As shown in FIGS. 4 and 7, in both the first and second bearing pedestal supports 13A and 13B, the axes of the grinding wheel bearing pedestals 9A and 9B are perpendicular to the grinding wheel bearing pedestal supports 13A and 13B. The horizontal positioning of the grinding wheel bearing pedestals are performed in the following manner. Seats 9*b* of the grinding wheel bearing pedestals 9A and 9B abut against seats 13*d* of the bearing pedestal supports 13A and 13B, respectively. In the opposite sides of the seats 13*d* with respect to the grinding wheel spindle 4, clamps 27 are fitted into holes of the bearing pedestal supports 13A and 13B, respectively. The positions of the tip ends of shaft portions 27*b* of the clamps 27 are adjusted by interposing spacers 27*c* between flanges 27*a* of the clamps 27 and the bearing pedestal supports 13A and 13B. The clamps 27 are fixed to the bearing pedestal supports 13A and 13B by fastening plural bolts (not shown) into the portions of the flanges 27*a*. In each of the clamps 27, the tip end of the shaft portion 27*b* has a vertical face 27*b*1 which is contacted with a seat 9*c* of the corresponding grinding wheel bearing pedestal 9A or 9B, and an upper tapered face 27*b*2. In the case of replacement of the grinding wheels, the tapered face 27*b*2 guides the attachment of the corresponding grinding wheel bearing pedestal 9A or 9B from the above, and the vertical face 27*b*1 abuts against the seat 9*c* of the grinding wheel bearing pedestal 9A or 9B, thereby attaining the horizontal clamping.

As shown in FIG. 2, a feed nut 3*f* having a female threaded portion is fixed to the wheel slide 3. Bearings 1*e* and 1*f* are supported on the bed 1. A feed screw 1*g* which is supported by the bearings 1*e* and if is screwed into the feed nut 3*f*. The feed screw 1*g* is coupled to the shaft of a servomotor 1*i* for providing cut feeding, via a shaft coupling 1*h*. The servomotor 1*i* is fixed to the bed 1. The operation of cutting the workpiece by the grinding wheels 5 is advanced by driving the servomotor 1*i* to rotate the feed screw 1*g* via the shaft coupling 1*h*, moving the feed nut 3*f* by the rotation, and guiding the wheel slide 3 along the slide bars 2*a* and 2*b*.

Next, the taper correcting apparatus will be described. The taper correcting apparatus is configured so as to move only one of the bearings 11A and 11B which respectively support the ends of the grinding wheel spindle 4. In the embodiment, the bearing 11B which is closer to the pulley 12 is adjusted so as to move back and forth with respect to the workpiece. First, the bearing 11B of the adjusting side will be described.

As shown in FIGS. 2 to 5, a round shaft support member 16 supporting a round shaft 15 which elongates in parallel with the workpiece center line Wc, i.e., in a direction perpendicular to the direction X is disposed integrally with the wheel slide 3, or fixed to the wheel slide 3. The grinding wheel bearing pedestal support 13B is rotatably fitted onto the round shaft 15.

Figure 5:
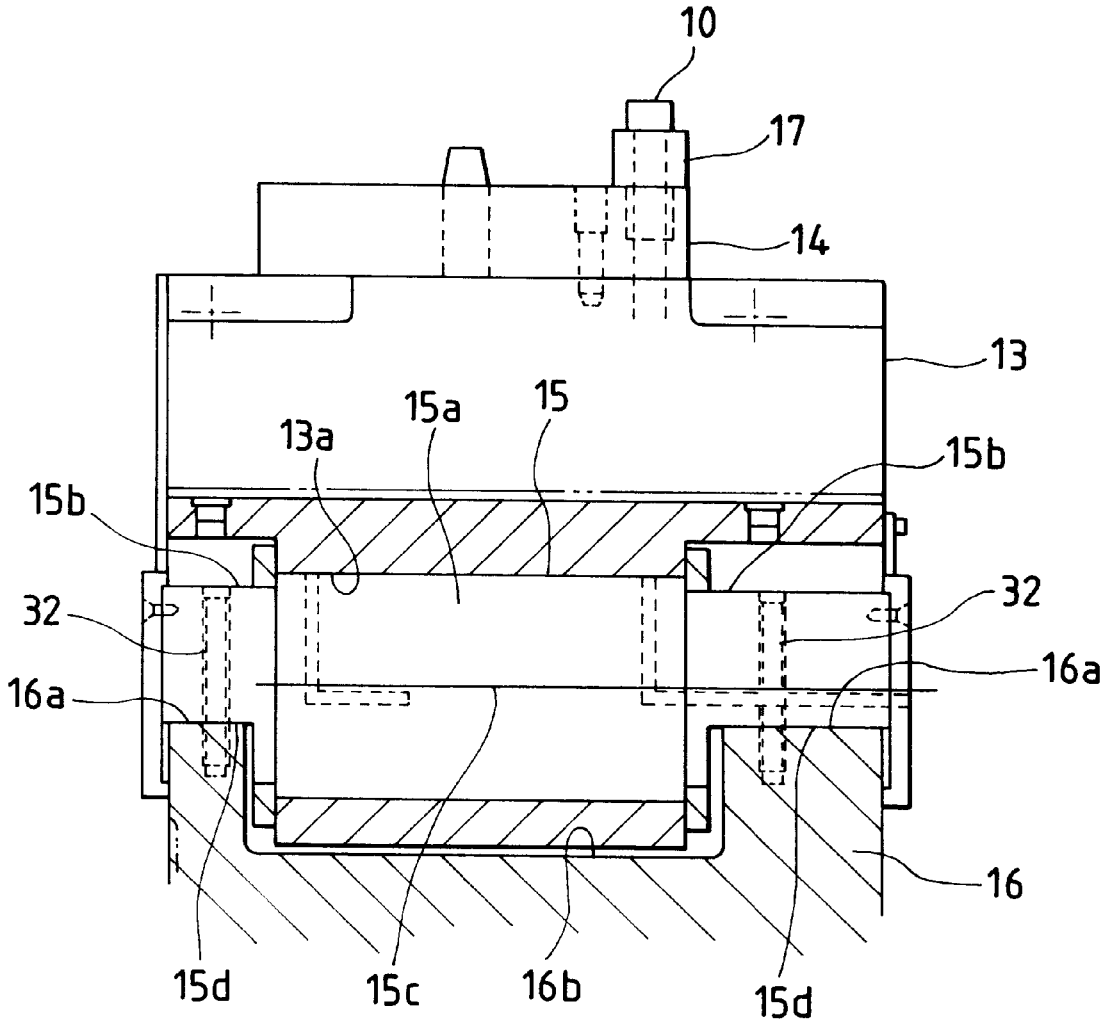
FIG. 5 is a section view taken along the line F—F of FIG. 3.

As shown in FIG. 5, the round shaft 15 has a large-diameter portion 15*a* at the center, and a small-diameter portion 15*b* at each of the ends. The lower side of the end side of each small-diameter portion 15*b* is cut away into a flat face, thereby forming a cut portion 15*d*. The cut portions 15*d* are contacted with flat portions 16*a* of the round shaft support member 16, respectively. The portion between the flat portions 16*a* of the both sides is downward retracted from the portions 16*a* so as to form a recess 16*b*. The round shaft 15 is fixed at the cut portions 15*d* to the round shaft support member 16 by bolts 32.

The large-diameter portion 15*a* of the round shaft 15 is fitted into a round hole 13*a* of the grinding wheel bearing pedestal support 13B. A pressurring device which causes the grinding wheel bearing pedestal support 13B to swing about the round shaft 15 will be described. As shown in FIGS. 3 and 4, a bracket portion 13*b* elongates from the grinding wheel bearing pedestal support 13B in a lateral direction with respect to a line connecting the center 15*c* of the round shaft 15 and the center Gc of the grinding wheel spindle 4. A female threaded portion 13*c* is formed in the bracket portion 13*b* so as to elongate substantially in parallel with a line connecting the center of the grinding wheel spindle 4 and the round hole 13*a*. An adjusting screw 18 is screwed into the female threaded portion 13*c* so that the position of the screw is adjustable. The adjusting screw 18 has a cylindrical portion 18*a* at the tip end. A pin 25 is pressingly inserted into the center of the tip end face of the cylindrical portion 18*a*.

The tip end face of the cylindrical portion 18*a* constitutes an abutting portion which is contacted with the outer circumferential face of a ring 21 while the tip end of the pin 25 is fitted into an oblong engaging hole 21*a* in the outer circumference of the ring 21. A contact 19 made of cemented carbide is disposed on the outer circumferential face of the ring 21, and the engaging hole 21*a* is formed in the contact 19, thereby improving durability against the pressure and friction of the contact with the adjusting screw 18. The adjusting screw 18 is locked to the grinding wheel bearing pedestal support 13B by, for example, screwing a lock nut 23 fastened with the screw.

A sleeve 24 is disposed on the wheel slide 3 so as to elongate along a side portion of the grinding wheel bearing pedestal support 13B which is parallel with the grinding wheel spindle 4. As shown in FIG. 6, a bearing 26 is fittingly supported in the sleeve 24. The tip end of a center shaft of a reduction gear 33 fixed to the sleeve 24 is supported by a bearing 28. A horizontal rotary shaft 29 is rotatably supported by the bearing 26 and a bearing (not shown) in the reduction gear 33.

The adjusting screw 18 and the rotary shaft 29 constitute an eccentric shaft device. Specifically, an eccentric shaft portion 29*a* serving as an eccentric shaft is formed in the rotary shaft 29. The eccentric shaft portion 29*a* has a cylindrical shape having the center line C2 at a position which is eccentric from the rotation center C1 of the rotary shaft 29. A bearing 31 is fitted onto the outer circumference of the eccentric shaft portion 29*a*. The ring 21 is fitted onto the bearing 31. Since the pin 25 is just fitted into the engaging hole 21*a* of the ring 21, the ring 21 is restrained from rotating. The contact 19 is made of cemented carbide. To comply with this, also the adjusting screw 18 is made of a hard material.

The inner race of the bearing 28 is fitted onto a shaft 33*a* of the reduction gear 33 fixed to the sleeve 24, and the outer race is fitted into a hole 29*b* of the rotary shaft 29. A large-diameter hole 29*c* which is concentric with the hole 29*b* of the rotary shaft 29 is fitted onto a spigot of an output portion 33*b* of the reduction gear 33, and bolts 34 which pass through the rotary shaft 29 in the axial direction are screwed into the output portion 33*b* of the reduction gear 33, thereby fixing the rotary shaft 29 to the output portion 33*b* of the reduction gear 33. The rotary shaft 29 is a stepped shaft having a diameter which is gradually reduced as moving from the right side to the left side in FIG. 6. In the bearing 31, the position in the axial direction of one end of the inner race is determined by a shoulder 29*d* of the rotary shaft 29. With starting from the inner race of the bearing 31 adjacent to the shoulder 29*d*, a collar 35, the inner race of the bearing 31, a collar 36, the inner race of the bearing 26, a collar 37, and the inner race of the bearing 26 are sequentially fitted onto the shaft 29 so as to be close to each other in the axial direction, and fixed by a lock nut 38 screwed to an end of the shaft 29. A cap 39 is fixed to an end of the sleeve 24 which is in the left side in FIG. 6. A gap between the sleeve 24 and the cylindrical portion 18*a* of the adjusting screw 18 which is inserted into the sleeve 24 is sealed by an oil seal 41.

The outer circumferences 24*a* and 24*b* of the sleeve 24 are fitted into holes 3*a* and 3*b* formed in the wheel slide 3, respectively. Bolts 42 passing through a flange 24*c* disposed at an end of the sleeve 24 which is in the right side in FIG. 6 are screwed into the wheel slide 3.

In order to adjust the origin of the rotation position, the shaft 29 has means for detecting the rotation position. The rotation position detecting means is formed by, for example, a position sensor 43 fixed to the sleeve 24, and a dog 44 fixed to the shaft 29. Specifically, the position sensor 43 is a proximity sensor, and the dog 44 is a conductor for activating the proximity sensor. According to this configuration, it is possible to know a position where, for example, the adjusting screw 18 of the shaft 29 is at zero lift.

The output shaft of a servomotor 46 is coupled to the input shaft of the reduction gear 33. The servomotor 46 is fixed to a motor stand 47 which is secured to the sleeve 24 by bolts 48. The motor stand 47 has a cylindrical shape and a part of the inner circumference is fitted onto the outer circumference of the reduction gear 33. The input and output shafts of the reduction gear 33 are concentric with each other. The outer circumference of the frame of the reduction gear 33 has a cylindrical shape which is centered at the center of the input and output shafts. The end of the outer circumference which is in the left side in FIG. 6 is fitted into the sleeve 24. A flange 33*c* disposed at a middle portion in the axial direction of the outer circumference is fastened together with the motor stand 47 by the bolts 48.

As shown in FIG. 4, the portion of the adjusting screw 18 which passes through a hole 3*d* of the wheel slide 3 is sealed by a seal ring 49. According to this configuration, dust and chips are prevented from entering the oil seal 41.

A clamp screw 51 serving as pressing means is disposed in the vicinity of and in parallel with the adjusting screw 18. The clamp screw 51 passes through the bracket portion 13*b* of the grinding wheel bearing pedestal support 13B via a group of disc springs 52 and is then imperfectly screwed into the wheel slide 3. The spring force exerted by the group of disc springs 52 causes the bracket portion 13*b* to be pressed toward the wheel slide 3 so that the adjusting screw 18 is urged in a direction along which the tip end of the screw is always pressingly contacted with the outer peripheral face of the ring.

In the embodiment, referring to FIG. 4, the distance between the center 15*c* of the round shaft 15 and the center Gc of the grinding wheel spindle 4 is substantially equal to that between the center 15*c* of the round shaft 15 and the center C1 of the shaft 29, and is 220 mm. In the embodiment, the distance between the bearings 11A and 11B which respectively support the ends of the grinding wheel spindle 4 is about 1,000 mm, and the maximum moving distance in a horizontal direction (X direction) perpendicular to the axis of the bearing 11B of the adjusting side is 0.1 mm in each of the plus and minus directions.

As the reduction gear 33, a reduction gear having no backlash, for example, RV reduction gear (trademark) is used so that an output is correctly obtained with respect to an input.

The function of the above-described configuration will be described. A taper of the workpiece is measured by manually measuring the end portions of the workpiece, or, when the machine is provided with automatic measuring or automatic transferring means, automatically measuring the end portions of the workpiece on the automatic transferring means. The measured values are input to a control device which is not shown. The control device calculates a correction value of the position of the bearing 11B, and a rotation angle of the servomotor 46 at which no taper is formed on the workpiece. The control device controls the servomotor 46 so as to rotate at this rotation angle required for the correction.

The instructions of the control device which is not shown cause via a driver the servomotor 46 to rotate. The output of the servomotor 46 is input to the reduction gear 33. The reduction gear 33 produces a speed-reduced output to rotate the shaft 29. When the shaft 29 is rotated, the eccentric shaft portion 29*a* of the shaft 29 is rotated while vertically changing the height of the center of the eccentric shaft portion 29*a*. As a result, the ring 21 which is restrained from rotating is vertically moved to cause the adjusting screw 18 via the contact 19 to be followingly moved in vertical directions.

When the adjusting screw 18 is pushed up, the grinding wheel bearing pedestal support 13B is rotated in a counter-clockwise direction in FIG. 4 about the round shaft 15, against the spring force of the disc springs 52. The maximum rotation angle of the grinding wheel bearing pedestal support 13B is about 180°.

As a result of the rotation of 180°, the end of the adjusting side of the grinding wheel spindle 4 (the lower side in FIG. 1) is displaced by about 0.2 mm toward the workpiece.

The adjusting screw 18 is always pressed against the ring 21 by the spring force of the group of disc springs 52 which press the bracket portion 13*b* of the grinding wheel bearing pedestal support 13B. Even when the ring 21 is downward displaced, therefore, the adjusting screw is downward moved without being separated from the ring 21, so that the grinding wheel bearing pedestal support 13B is rotated about the round shaft 15 in a clockwise direction in FIG. 4. As a result, the end of the adjusting side of the grinding wheel spindle 4 (the lower side in FIG. 1) is displaced by 0.2 mm at the maximum in the direction along which the end is separated from the workpiece.

When the taper correction of the grinding wheel spindle 4 is performed in this way, a force is exerted so that the center line Gc of the grinding wheel spindle 4 intersects in a horizontal plane with the center lines of the bearings 11A and 11B which support the grinding wheel spindle 4. The tilting of the center line Gc of the grinding wheel spindle 4 in this horizontal plane is allowed within a range of the static pressure gap in the bearings 11A and 11B.

When the embodiment is summarized, the embodiment is the taper correcting apparatus for the grinding machine which comprises: the head stock 6 and the tail stock 7 serving as workpiece supporting means for supporting the workpiece in parallel with the grinding wheel spindle 4; and a cutting and feeding device which moves back and forth the cylindrical grinding wheels 5 with respect to the workpiece, and which machine corrects parallelism between a center line of the workpiece and a center line of the grinding wheel spindle. The taper correcting apparatus comprises: the wheel slide 3 which is attached to the bed 1 so as to be movable back and forth with respect to the workpiece; a pair of grinding wheel bearing pedestals 9A and 9B which rotatably support the ends of the grinding wheel spindle 4 via the bearings 11A and 11*b* with respect to the wheel slide 3, respectively; the first grinding wheel bearing pedestal support 13A which is fixed to the wheel slide 3, and which clampingly supports the one grinding wheel bearing pedestal 9A; the second grinding wheel bearing pedestal support 13B which is attached so as to be rotatable about the round shaft 15, and which clampingly supports the other grinding wheel bearing pedestal 9B, the round shaft being attached below the grinding wheel spindle 4 to the wheel slide 3 in parallel with the center line of the workpiece; a pressurring device which presses the second grinding wheel bearing pedestal support 13B to rotate the grinding wheel bearing pedestal support 13*b* about the round shaft 15, thereby changing the distance between the center of the grinding wheel spindle and the center of the workpiece; and controlling means for controlling a pressing amount of the pressurring device.

In the above configuration, the pressurring device is an eccentric shaft device comprising: the eccentric shaft portion 29*a* which is coupled to the output portion of the reduction gear 33 with setting the center of the eccentric shaft to be eccentric, the input shaft of the reduction gear being coupled to the servomotor 46; the ring 21 which is rotatably fitted onto the outer circumference of the eccentric shaft portion 29*a*; the engaging hole 21*a* which is formed in the outer circumference of the ring 21; the bracket portion 13*b* which is disposed on the second grinding wheel bearing pedestal support 13B, and which has the abutting portion that is to abut against the outer circumference of the ring 21, the bracket portion elongating in a lateral direction with respect to the line connecting the center of the round shaft 15 and the center of the grinding wheel bearing 11B; the engaging pin which protrudes from the abutting portion, and which is engaged with the engaging hole 21*a* in the outer circumference of the ring 21; and the pressing member which passes through the bracket portion 13*b* via the spring members 52 to be fixed to the wheel slide, and which presses the bracket portion by means of the spring members 52 so that the abutting portion of the bracket portion 13*b* is always pressingly contacted with the outer circumference of the ring 21.

In the above configuration, the bearings 11A and 11B have the a bearing gap which allows the grinding wheel spindle 4 to be tilted in a predetermined range.

Moreover, another of the invention will be described with reference to FIGS. 8 to 21.

Figure 8:
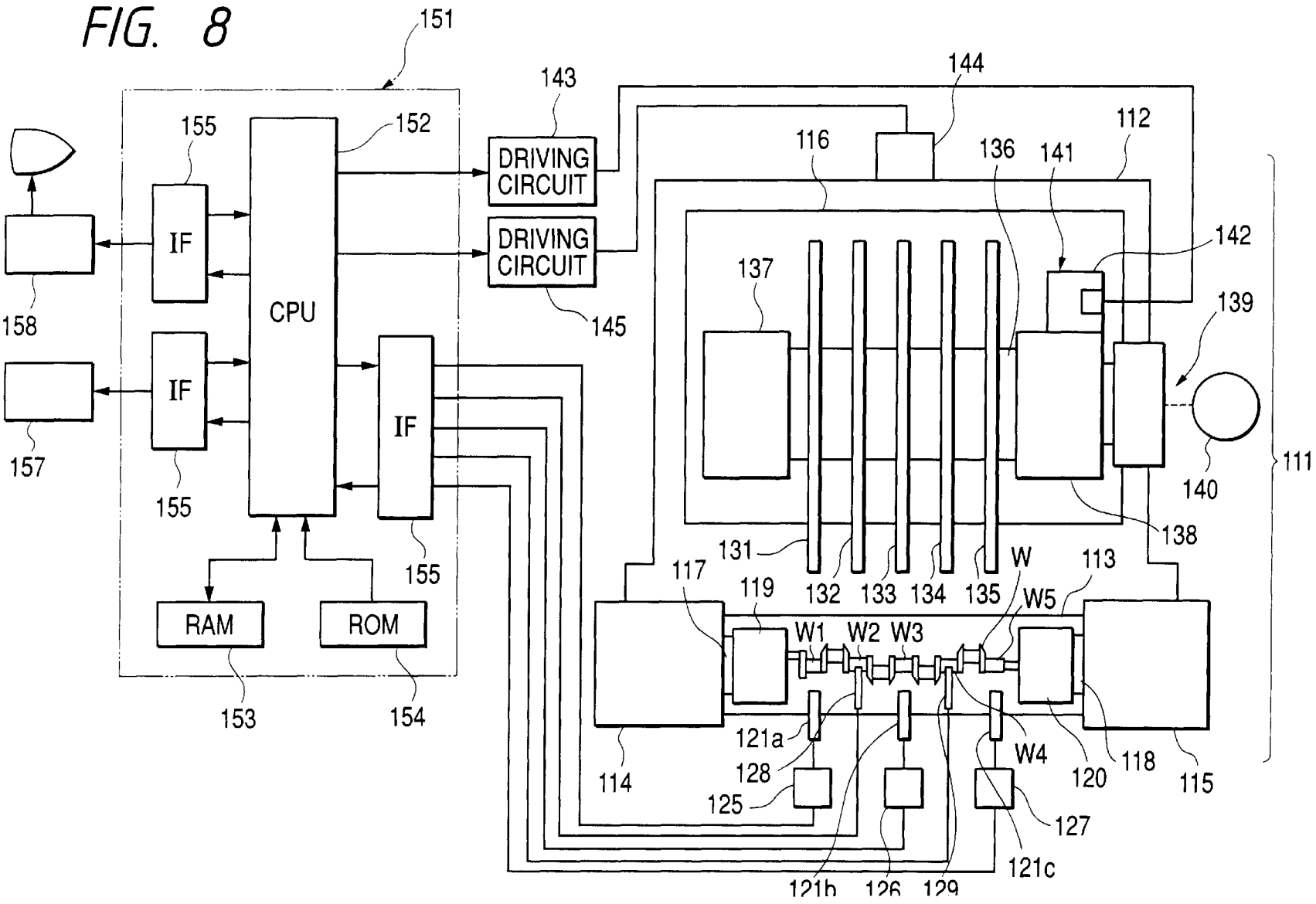
FIG. 8 is a diagram showing a control device of a grinding machine according to a second embodiment of the invention.

FIG. 8 is a diagram showing the whole configuration in which the invention is applied to a grinding machine for grinding journals of a crank shaft. In FIG. 8, a grinding machine 11 simultaneously grinds five journals W1, W2, W3, W4, and W5 in a ground portion of a crank shaft W (hereinafter, referred to as a workpiece W). A numerical control device 151 controls the grinding machine 111. A table 113 is disposed on the upper face of a bed 112 of the grinding machine 111. Workpiece spindle stocks 114 and 115 which support the workpiece W are disposed at two or right and left portions on the table 113, respectively. A wheel spindle stock 116 is mounted in a rear side portion of the bed 112 so as to be reciprocable with respect to the workpiece W.

The workpiece spindle stocks 114 and 115 respectively comprise servomotors (not shown) which are synchronously controlled by the numerical control device 151. Chucks 119 and 120 are attached to tip ends of spindles 117 and 118 which are rotated by the servomotors. The chucks 119 and 120 clamp the journals at the ends of the workpiece W, respectively. Referring to FIG. 8, first to third rest devices 121*a*, 121*b*, and 121*c* are mounted on the table 113 so as to be located between the workpiece spindle stocks 114 and 115. The rest devices 121*a*, 121*b*, and 121*c* support the journals W1, W3, and W5 of the journals W1, W2, W3, W4, and W5 under a grinding work, at positions where the outer circumferences are opposed to grinding wheels 131, 133, and 135, respectively. First and second sizing devices 128 and 129 are mounted between the rest devices 121*a*, 121*b*, and 121*c* on the table 113 so as to be opposed to the journals W2 and W4 of the workpiece W, respectively. The measured values of outer diameters of the journals W2 and W4 which are obtained by the sizing devices 128 and 129 are supplied to the numerical control device 151.

The wheel spindle stock 116 comprises first to fifth grinding wheels 131, 132, 133, 134, and 135 which simultaneously grind the first to fifth journals W1 to W5 that are arranged in the direction of the rotation axis O1 of the workpiece W, and a grinding wheel spindle 136 to which the grinding wheels 131 to 135 are attached. The grinding wheel spindle 136 is supported by bearing members 137 and 138 on the table 113. A driving pulley 139 is fittingly fixed to one end portion of the grinding wheel spindle 136, and rotated by a driving belt which is not shown and a driving motor 140. Inclination adjusting means 141 for adjusting an inclination of the rotation axis O2 of the grinding wheels 131 to 135 with respect to the rotation axis O1 of the workpiece W so as to correct a taper of the workpiece W to "zero" is mounted on the one bearing member 138. A servomotor 142 of the inclination adjusting means 141 is connected to the numerical control device 151 via a driving circuit 143. A servomotor 144 for advancing the wheel spindle stock is attached to the bed 112. The servomotor rotates forward and rearward to move forth and back the wheel spindle stock 116 with respect to the workpiece W. The motor 144 is connected to the numerical control device 151 via a driving circuit 145.

The numerical control device 151 comprises a central processing unit (hereinafter, referred to as a CPU) 152 which controls and manages various operations of the whole of the grinding machine, a random access memory (hereinafter, referred to as a RAM) 153, and a read only memory (hereinafter, referred to as a ROM) 154. The RAM 153 stores programs for grinding the journals W1 to W5 of the workpiece W, programs for controlling the operations of the rest devices, etc. An interface (IF) 155, an input device 157 having a keyboard through which control data and the like are input, and a display device 158 having a display screen and the like are provided. Rotation position detectors (not shown) of the servomotors 142 and 144 are connected to the numerical control device 151.

Next, the first to third rest devices 121*a*, 121*b*, and 121*c*, and the sizing devices 128 and 129 will be described.

Figure 9:
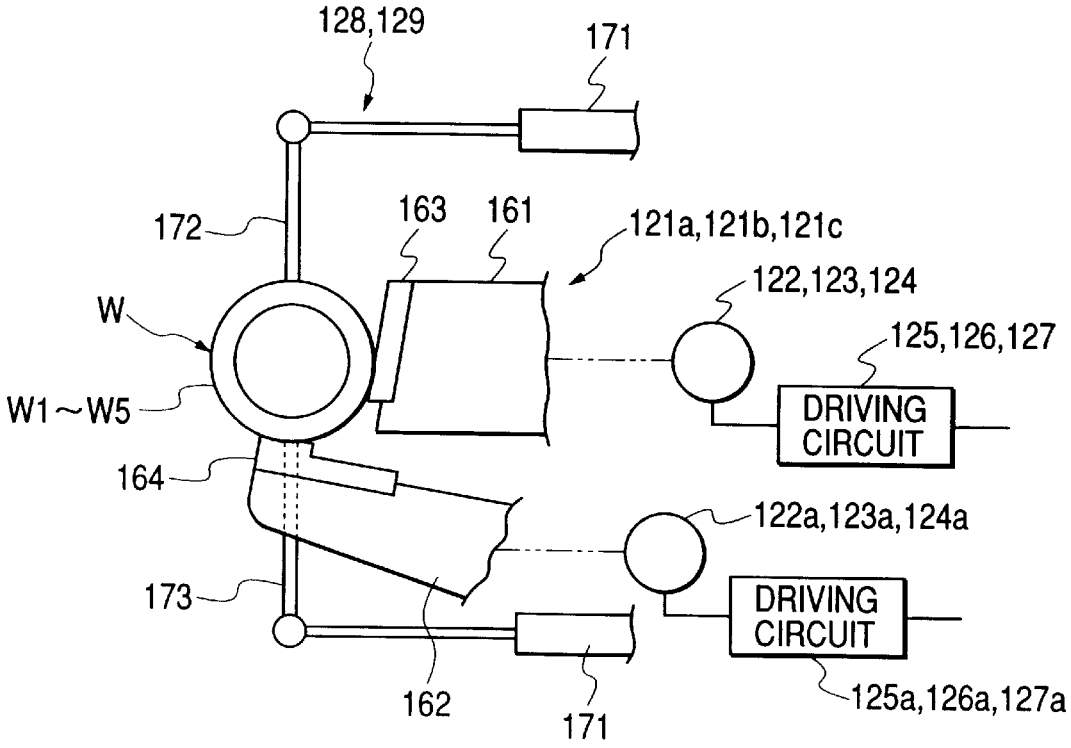
FIG. 9 is a side view showing the structure of rest devices and sizing devices.

The rest devices 121*a*, 121*b*, and 121*c* comprise feeding servomotors 122, 123, and 124 which are mounted on the table 113 and correspond to the three journals W1, W3, and W5, respectively. The servomotors 122, 123, and 124 are connected to the numerical control device 151 via respective driving circuits 125, 126, and 127. As shown in FIG. 9, each of the journals W1, W3, and W5 of the workpiece W is supported by upper and lower shoes 163 and 164 attached to upper and lower rams 161 and 162 constituting the corresponding rest device 121*a*, 121*b*, or 121*c*. During a work of grinding the journals W1, W3, and W5 of the workpiece by the grinding wheels 131, 133, and 135, the rest devices support the pressing forces of the grinding wheels 131, 133, and 135, from the opposite side and the lower side, thereby enabling the grinding of the workpiece to be adequately performed. The upper rams 161 are individually moved forth and back with respect to the journals W1, W3, and W5 of the workpiece in a horizontal direction by the feeding servomotors 122, 123, and 124. The lower rams 162 are individually reciprocated with respect to the journals W1, W3, and W5 of the workpiece in a vertical direction by feeding servomotors 122*a*, 123*a*, and 124*a*. The servomotors 122*a*, 123*a*, and 124*a* are connected to the numerical control device 151 via respective driving circuits 125*a*, 126*a*, and 127*a*.

Each of the sizing devices 128 and 129 comprises a pair of upper and lower measurement levers 172 and 173 which are supported by a support member 171. The measurement levers 172 and 173 respectively abut against the outer circumferential faces of the second and fourth journals W2 and W4 of the first to fifth journals W1 to W5, from the upper and lower sides. The mechanical displacement of the levers 172 and 173 are converted into electric signals by internal differential transformers (not shown). The signals are output as outer diameter dimension signals to the numerical control device 151. In the embodiment, the outer diameters of the second and fourth journals W2 and W4 are measured. Alternatively, the measurement positions may be set to be the journals W1 and W5 or W1 and W4. In summary, arbitrarily selected ones of the journals may be measured as far as a taper of the journals W1 to W5 of the workpiece can be measured. The outer diameters of ground surfaces of end portions of a workpiece which are set forth in the claims include dimensions which are measured as described above.

Figure 10:
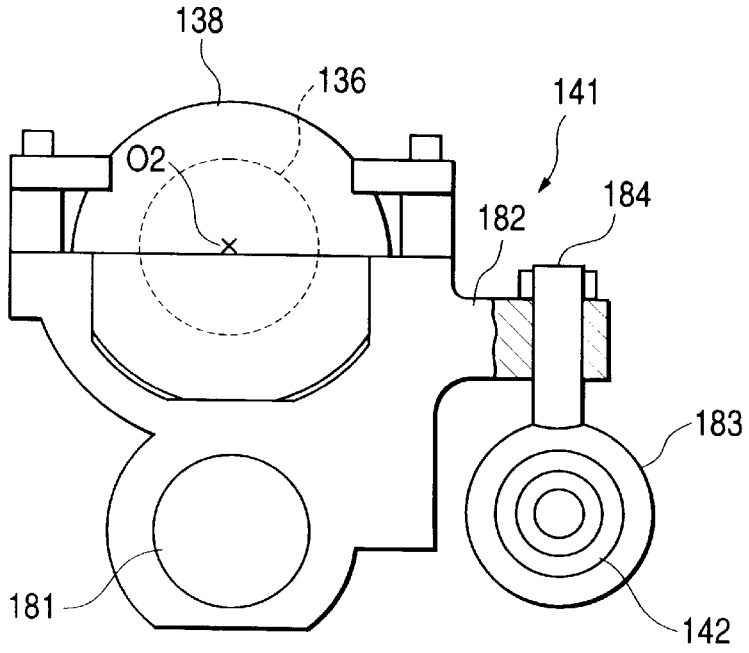
FIG. 10 is a front section view showing inclination adjusting means.

Next, the configuration of the inclination adjusting means 141 for the rotation axis O2 of the grinding wheel spindle 136 will be described with reference to FIG. 10.

Figure 11:
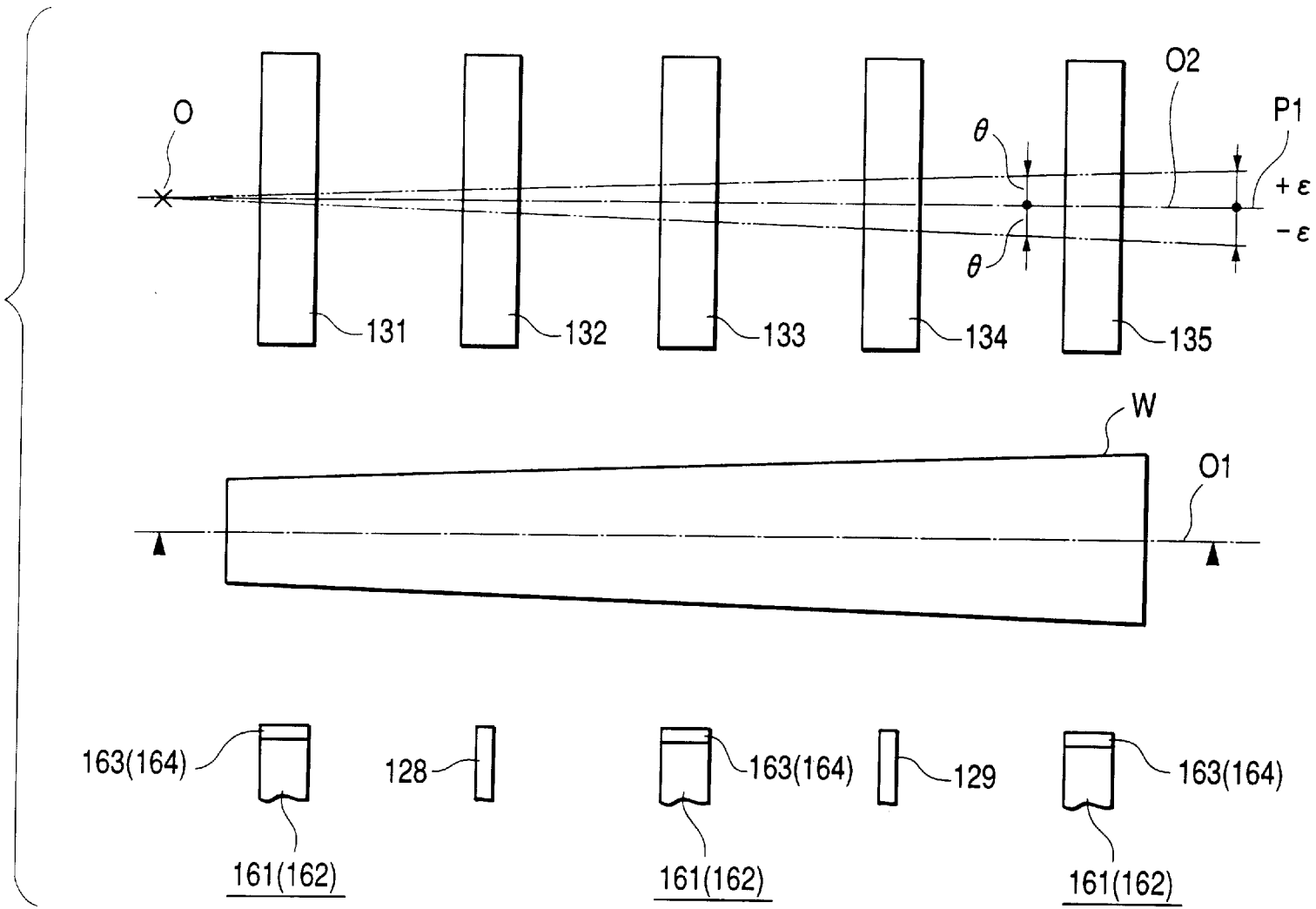
FIG. 11 is a schematic plan view showing relationships among a workpiece, grinding wheels, and the rest devices.

One of the pair of the bearing members 137 and 138 supporting the grinding wheel spindle 136, i.e., the bearing member 138 is supported by a bracket 182 which is fixedly attached to a fixing support shaft 181 supported by the wheel spindle stock 116. A cam 183 is supported at a position which is laterally separated from the fixing support shaft 181, so as to be rotatable at a predetermined position. An operating rod 184 is vertically moved by the cam 183, so that the bearing member 138 is reciprocated in a horizontal direction in FIG. 10. According to this configuration, as shown in FIG. 11, an inclination $\theta$ of the rotation axis O2 of the grinding wheels 131 to 135 with respect to the rotation axis O1 of the workpiece W and about a fulcrum O can be adjusted to the plus or minus side from a reference position where the axes O1 and O2 are parallel with each other, so that the difference $\delta$ (0 $\mu$m) between outer diameters of the journals W2 and W4 of the workpiece W is adjusted to be zero (there is no taper), or that the outer diameter difference $\delta$ becomes a preset target value ($\mu$m>0).

In the embodiment, the inclination $\theta$ serves also as a correction amount of a correction point P1 on the rotation axis O2 which is to be exerted by the inclination adjusting means 41. Therefore, the inclination $\theta$ is called the taper correction amount $\epsilon$ of the rotation axis O2 of the grinding wheels.

Next, first to third taper correction methods in which a taper of the workpiece W is corrected by using the thus configured grinding machine will be described.

In the first taper correction method, the taper correction is performed during a grinding work so that the target value of the difference δ between outer diameters of the journals W2 and W4 of the end portions of the workpiece W becomes "zero." Therefore, the correction method applies to a workpiece in which, even when the outer diameter difference δ is measured at ordinary temperature after the workpiece W is unloaded from the grinding machine, the difference remains to be "zero."

Figure 12:
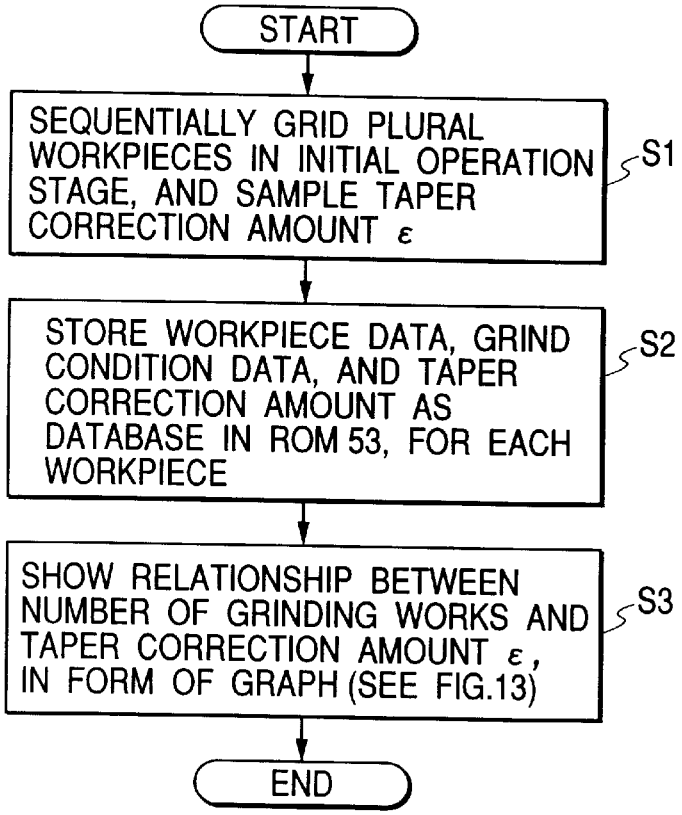
FIG. 12 is a flowchart of a process of producing a database.

FIG. 12 is a flowchart showing operation steps in which a work of grinding the workpiece W is performed plural times (for example, first to thirteen times) until a grinding work is enabled to be stably performed after the activation of the grinding machine, and the relationship between the number of works and the taper correction amount ϵ is previously obtained.

In step S1 of FIG. 12, taper correction amounts ϵ of plural times (first to thirteen times) which are performed after the activation of the grinding machine until the taper correction amount ϵ of the grinding wheels 131 to 135 that is proportional to the inclination θ of the rotation axis O2 of the grinding wheels 131 to 135 with respect to the rotation axis O1 is satisfied are sampled.

In step S2, taper correction amounts ϵ of the number of the grinding works which are obtained in step S1 are stored in the RAM 153, together with workpiece data including the kinds, lengths, weights, materials, and hardnesses of the workpieces, and grind condition data including rotational speeds and feeding speeds of the grinding wheels 131 to 135.

For example, the workpiece data include the kinds (crank shaft, cam shaft), lengths (300 mm, 400 mm), weights (10 kg, 12 kg, 14 kg), materials (S53C, FCD70), and hardnesses (RD90, RB100) of the workpiece, and the condition data include rotational speeds (coarse grinding: 120 rpm, intermediate grinding: 80 rpm, fine grinding: 60 rpm) of the spindles 117 and 118, and feeding speeds (coarse grinding: 80 μm/sec., intermediate grinding: 20 μm/sec., fine grinding: 3 μm/sec.) of the grinding wheels.

Figure 13:
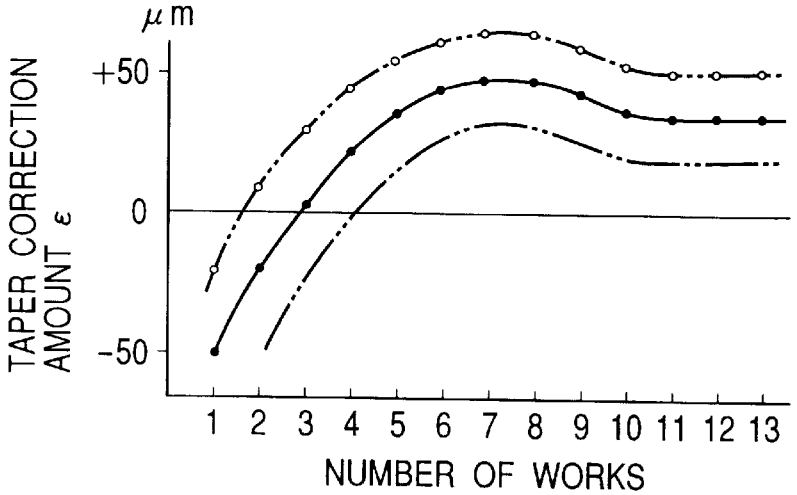
FIG. 13 is a graph showing relationships between the number of grinding works and a taper correction amount.

In step S3, on the basis of the data stored in the database which is obtained in step S2, the trend of taper correction amounts ϵ of the first to thirteen times on the workpieces W of the same kind and the same specification is obtained in the form of a graph such as that of FIG. 13. This is stored as a database in the RAM 153. Similar sampling is performed on workpieces of different kinds, and the trends of taper correction amounts ϵ of the first to thirteen times on the different kinds are stored as the database.

Next, an operation in which a test grinding work is performed on a workpiece W on the basis of the taper correction amount ϵ of the thus obtained database, and an operation of checking whether the accuracy of the stored taper correction amount ϵ attains the target accuracy or not will be described with reference to a flowchart of FIG. 14.

Figure 14:
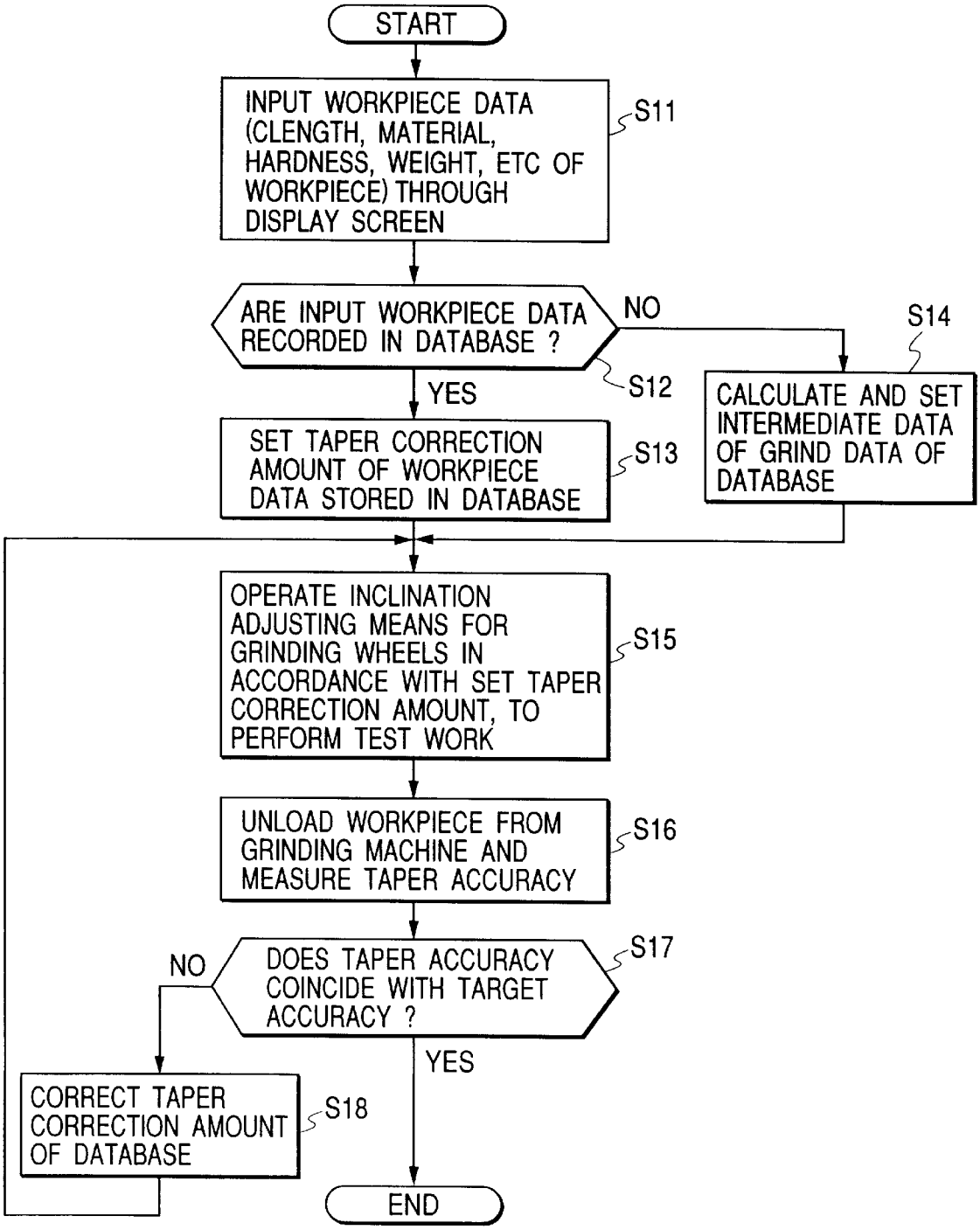
FIG. 14 is a flowchart of a process in the case where a test work is performed by using a preset taper correction amount.

Referring to FIG. 14, in step S11, the workpiece data (length, material, hardness, weight, and kinds such as a crankshaft or a cam shaft) of the workpiece W which is to be subjected to a test grinding work are input through the input device 157 while observing the screen of the display device.

Next, it is judged in step S12 whether the input workpiece data are stored in the database or not. If YES, the taper correction amount ϵ of the corresponding workpiece and stored in the database is retrieved in step S13 and the retrieved amount is set. If it is judged NO in step S12, an intermediate taper correction amount ϵ is calculated in step S14 from the trend graph of the taper correction amount ϵ in the database and the calculated amount is set.

In step S15, in accordance with the set taper correction amount ϵ, the inclination adjusting means 141 for the grinding wheels 131 to 135 is operated so as to perform a test grinding work on the workpiece W. Next, the taper accuracy of the ground workpiece W is measured instep S16. It is judged instep S17 whether the measured taper accuracy coincides with the target accuracy or not. If YES, the operation is ended without correcting the taper correction amount ϵ stored in the database. By contrast, if it is judged NO in step S17, the taper correction amount ϵ in the database is corrected in step S18 and then the operation is returned to step S15 to perform a test work. In this way, the trend graph of the taper correction amount ϵ shown in FIG. 13 is corrected to a further accurate one.

Next, an operation in which a work of grinding a workpiece W is newly performed on the basis of the database which is obtained as described above and which stores the relationships (trend graph) between the number of grinding works on works of various kinds and the taper correction amount ϵ will be described with reference to a flowchart of FIG. 15.

Figure 15:
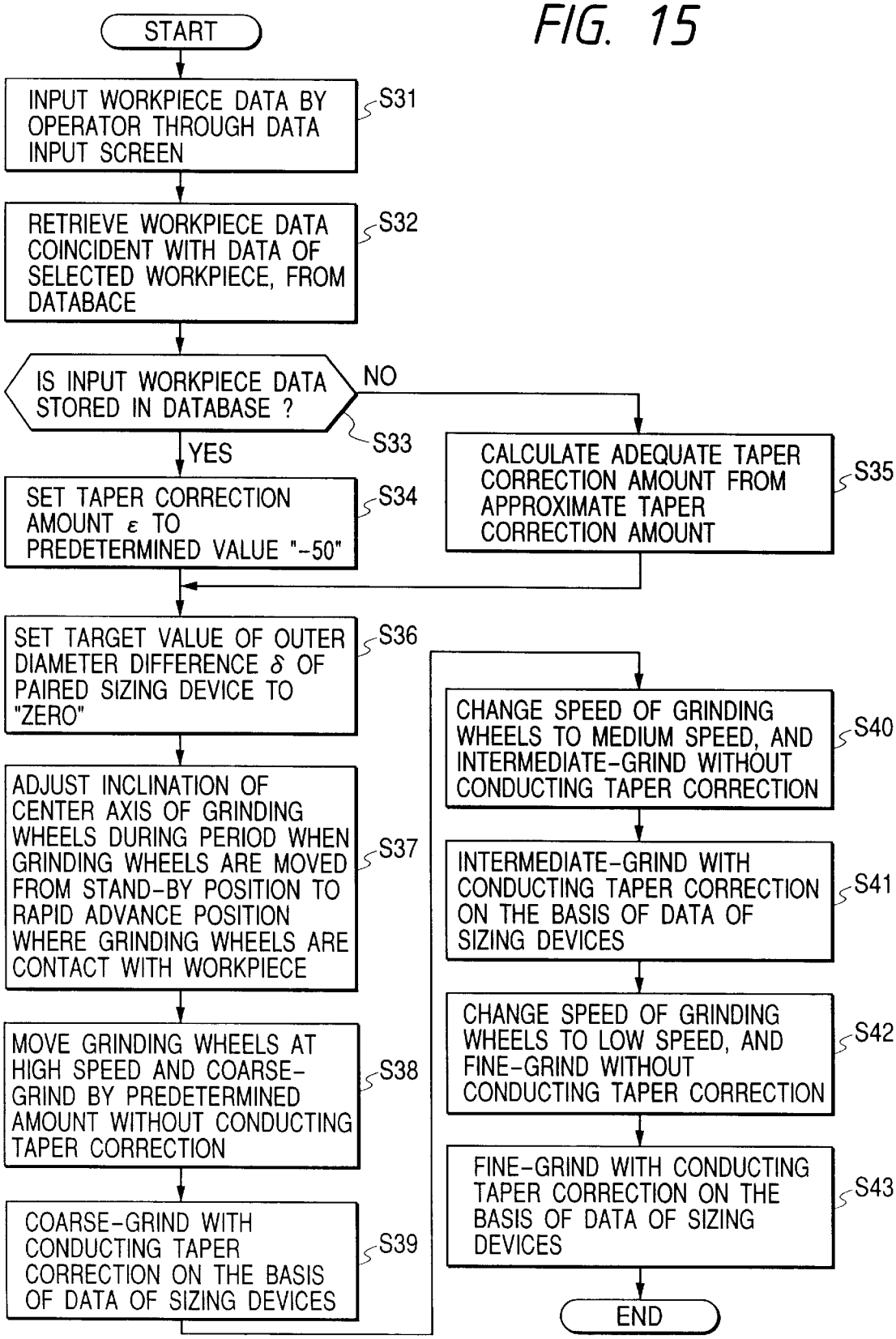
FIG. 15 is a flowchart showing a taper correction operation.

In step S31 of FIG. 15, when a first work of grinding a workpiece W is to be performed immediately after the activation switch of the grinding machine is turned ON, data of the workpiece are input through the input device 157. When the kind of the workpiece is a crank shaft, for example, the length: 300 mm, the weight: 10 kg, the material: FCD70, and the hardness: RB90 are input as the workpiece data. In step S32, an operation of retrieving, from the database, workpiece data coincident with the data of the workpiece of the first time which is to be newly ground is started. If it is judged in step S33 that the input workpiece data are stored in the database, the taper correction amount "ϵ=−50 μm (see the graph of FIG. 13)" of the workpiece of the first time is retrieved from the database, and the retrieved value is set as the taper correction amount ϵ of the grinding wheels 131 to 135 in the grinding of the workpiece of the first time which is to be newly ground. If it is judged NO in step S33, an adequate taper correction amount ϵ is calculated from the trend graph shown in FIG. 13, and the operation is transferred to step S36.

In step S36, the target value of the difference δ between outer diameters of the journals W2 and W4 in the pair of the sizing devices 128 and 129 is set to be "zero" and then held. See FIG. 16A.

In step S37, during a period when the grinding wheels 131 to 135 are positioned from their standby position to a position which is immediately before a position where the grinding wheels are to be contacted with the workpiece W, the inclination θ of the rotation axis O2 of the grinding wheels 131 to 135 is changed so as to change the taper correction amount θ to be −50 μm.

Then, the grinding wheels 131 to 135 are moved in step S38 at a high speed (80 μm/sec.) from the rapid advance position in a direction perpendicular to the rotation axis O1 of the workpiece W, while the inclination θ of the rotation axis O2 of the grinding wheels 131 to 135 is held to a predetermined value, thereby performing coarse grinding by a predetermined amount. Next, coarse grinding is performed in step S39 by a predetermined amount while conducting the taper correction on the basis of the data of outer diameters of the sizing devices 128 and 129.

In step S38 above, when the outer diameters of the journals W2 and W4 of the workpiece W are 25 mm, for example, the amount of coarse grinding is set to be 800 μm in the term of the removal margin of the diameter In this case, the coarse grinding work is performed without conducting the taper correction by the inclination adjusting means 41, until the grinding amount reaches 600 μm. When the remaining removal margin is 200 μm, coarse grinding is performed so that the difference δ between the outer diameters of the journals W2 and W4 is within the allowable range of ±15 um with setting "zero" as the target value, on the basis of the measured data of outer diameters of the journals W2 and W4 of the sizing devices 128 and 129. See FIG. 16A.

When the coarse grinding is ended, the feeding speed of the grinding wheels 131 to 135 is switched from the high speed to a medium speed (20 μm/sec.), and intermediate grinding is performed in step S40 by a predetermined amount without conducting the taper correction. When the dimensions of outer diameters of the journals W2 and W4 of the sizing devices 128 and 129 reach a preset value, intermediate grinding is performed in step S41 on the basis of the measured data with conducting the taper correction.

When the amount of the intermediate grinding is 100 μm, for example, the taper correction is not conducted until the grinding amount reaches 80 μm. At the timing when the remaining margin reaches 20 μm, the taper correction is started, and the intermediate grinding is performed so that the difference δ between the outer diameters of the journals W2 and W4 of the workpiece is within the allowable range of ±5 μm during the grinding with setting "zero" as the target value. See FIG. 16A.

In step S42, the feeding speed of the grinding wheels is switched from the medium speed to a low speed (3 μm/sec.), and fine grinding is performed by a predetermined amount without conducting the taper correction. When the outer diameters of the sizing devices 128 and 129 reach a preset value, fine grinding is performed in step S43 on the basis of the measured data and with conducting the taper correction.

When the amount of the fine grinding is 50 μm, for example, the taper correction is not conducted until the grinding amount reaches 40 μm. During the fine grinding of the remaining margin of 10 μm, fine grinding is performed so that the difference δ between the outer diameters of the journals W2 and W4 of the workpiece is within the allowable range of ±2 μm during the fine grinding with setting "zero" as the target value. See FIG. 16A. Finally, the journals W2 and W4 are ground so as to have an outer diameter of 24.05 mm.

Effects of the above-described first taper correction method in the grinding machine will be listed together with the configuration.

(1) In the embodiment, for each kind of a workpiece, the trend of the taper correction amount ϵ of the grinding wheels 31 to 35 of first to n-th times is stored in the database, and, when a next workpiece is to be ground, a data of the corresponding workpiece and the same grinding number is retrieved from the database, and the taper correction amount ϵ of the grinding wheels 131 to 135 is corrected before the start of the grinding, on the basis of the taper correction amount ϵ. As compared with a configuration in which the inclination θ of the rotation axis O2 of grinding wheels is adjusted during a work of grinding a workpiece so as to correct a taper of the workpiece, therefore, the taper correction amount ϵ during the grinding can be set to be minimum. The time period required for the taper correction can be shortened, and hence a work of grinding a workpiece can be efficiently performed.

(2) In the embodiment, the target value of the difference δ between the outer diameters of the journals W2 and W4 of a workpiece is set with being centered at "zero," and the allowable range with respect to the target value is stepwise reduced in the sequence of coarse grinding, intermediate grinding, and fine grinding. In each grinding step, therefore, the actual taper correction amount ϵ in the grinding work can be made small so that the surface roughness of the ground surface of a workpiece is improved.

(3) In the embodiment, the taper correction amount ϵ of the grinding wheels during a grinding work can be largely reduced. Therefore, the adjust range of the advance position where the first to third rest devices 121*a*, 121*b*, and 121*c* are contacted with the workpiece, and the control range of the torque can be made smaller. Accordingly, the following effects are attained.

During a work of grinding a workpiece, in order to improve the roundness and straightness of the workpiece, the torques (currents) of the servomotors 122, 123, 124, 122*a*, 123*a*, and 124*a* are controlled so that the pressing force on the ground workpiece and exerted by the upper and lower shoes 163 and 164 of the rest device 121*a*, 121*b*, or 121*c* are constant. Conventinaly, the taper correction by the grinding wheels 31 to 35 is conducted in a large range during a work of grinding a workpiece, and hence the grinding amount of the workpiece is largely varied in the lateral directions, and also the pressing force is varied. Consequently, the rest devices 121*a*, 121*b*, and 121*c* must be rapidly controlled in accordance with these variations. When the responsibility of the control is low, a failure in the positions of the rest devices causes the function of supporting of the journals W1 to W5 of the workpiece to be excessively increased or deficiently reduced. By contrast, in the embodiment, the taper correction amount ϵ during a grinding work is very small as described above. Therefore, the control range of the torque of the rest devices 121*a*, 121*b*, and 121*c*, or the preset range of the advance position where the support of a workpiece is started is made smaller. Even by the setting of the advance position or the torque control method of existing rest devices, the roundness and straightness of a workpiece can be improved.

In order to further enhance the effect, the following control of the rest device is effective.

Since the taper correction amount ϵ of the grinding wheels 131, 133, and 135 is previously retrieved and set before a work of grinding a workpiece, the pressing forces on the workpiece W ane exerted by the grinding wheels 131, 133, and 135 are varied depending on the degree of the cutting depth of the journals W1, W3, and W5 of the workpiece W. In accordance with the variation of the pressing forces, the setting of the advance positions of the upper and lower shoes 163 and 164 of the rest device 121 a, 121*b*, and 121*c*, and the pressing force on the workpiece at the timing of starting a grinding work, i.e., the torques (currents) of the servomotors 122, 122*a*, 123, 123*a*, 124, and 124*a* are adjusted for each of the rest device 121*a*, 121*b*, and 121*c*, whereby the function of supporting the workpiece can be optimized so as to further improve the accuracy of the roundness and straightness of a workpiece.

In the first taper correction method described above, the setting is performed so that the difference δ between the outer diameters of the journals W2 and W4 based on the measured data from the sizing devices 128 and 129 coincides with the target value "zero," and the inclination θ of the rotation axis O2 of the grinding wheels 131 to 135 is controlled so as to be converged to the target value. In some kinds of workpieces, even in the case where the outer diameters of the journals W2 and W4 are equal to each other or no taper is formed immediately after a grinding work by a grinding machine is ended, when the outer diameters of the ends of the workpiece are measured after the elapse of several hours from the unloading of the workpiece from the grinding machine, the outer diameters may be different from each other. It is empirically known that the outer diameter difference δ is varied depending on the kind of a workpiece. When the outer diameter difference δ of a workpiece at ordinary temperature is used as a data for correcting the target value "zero" of the outer diameter difference δ of a workpiece during a grinding work, therefore, the taper accuracy of the workpiece can be further improved.

The second taper correction method will be described.

The above-mentioned RAM 153 previously stores, as the database, workpiece data including kinds, lengths, weights, materials, and hardnesses of workpieces, grind condition data including rotational speeds and feeding speeds of the grinding wheels 131 to 135, and a target value of the outer diameter difference δ of each workpiece. Table 1 below shows a list of the database.

Next, the third taper correction method in which a temperature correction is performed on a workpiece will be described with reference to FIGS. 20 and 21.

Figure 20:
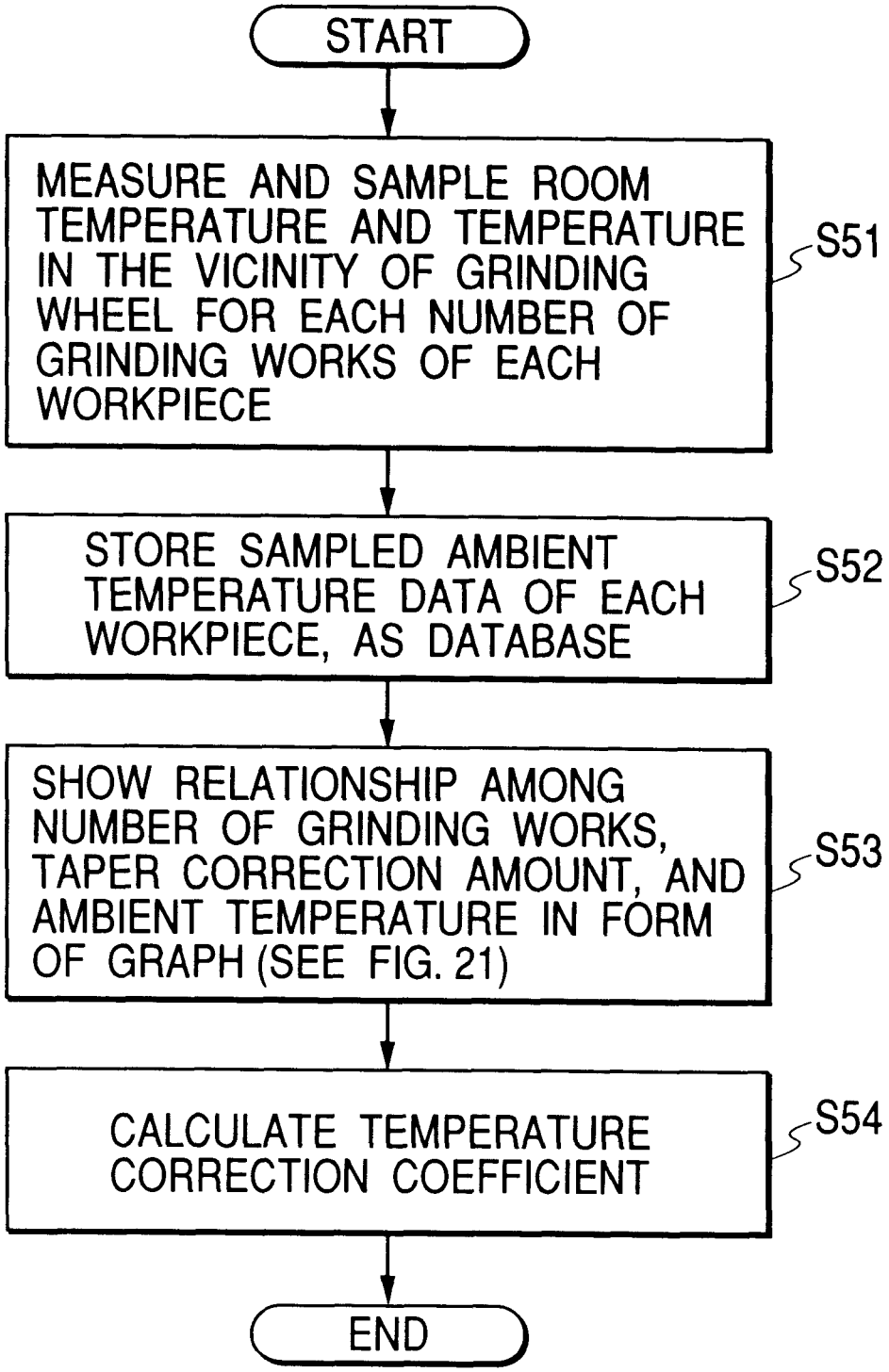
FIG. 20 is a flowchart of a process of obtaining relationships between data of ambient temperature and a correction amount.
Figure 21:
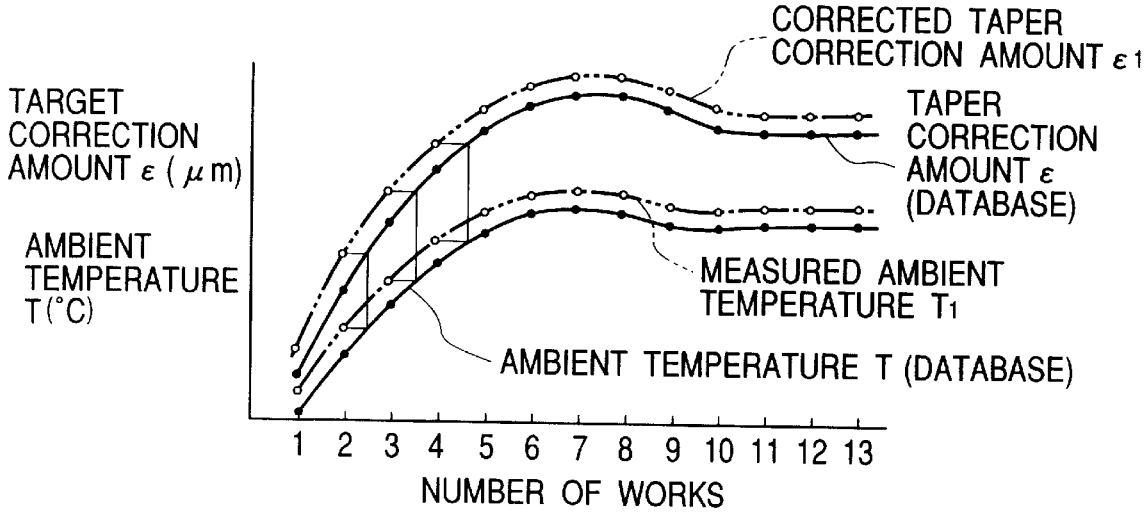
FIG. 21 is a graph showing relationships between data of ambient temperature and a taper correction amount.
Figure 22:
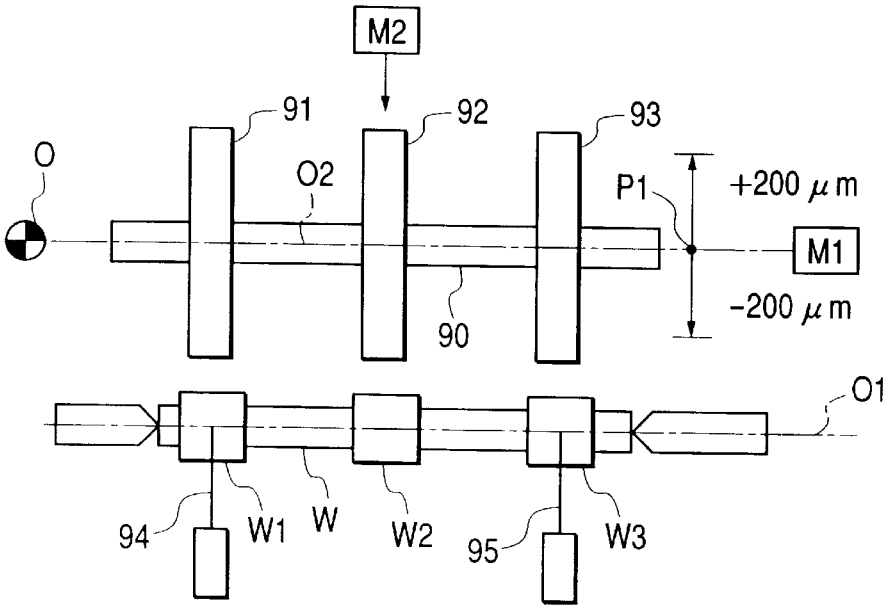
FIG. 22 is a schematic plan view showing a conventional apparatus for correcting a taper of a workpiece.

In the correction method, the temperature of a room where the grinding machine is placed, and that in the vicinity of the grinding wheel spindle 36 are sampled in step S51 of FIG. 20, for each of first to n-th workpiece grinding works. In step S52, the sampled data are recorded into the database. In step S53, the relationships among the number of grinding works, the taper correction amount, and the ambient temperature are converted into a graph as shown in FIG. 21 and stored as the database in the RAM 153. A temperature correction coefficient is calculated in step S54. The coefficient can be obtained from the trend graphs of the ambient temperature T and the taper correction amount ϵ which are indicated in FIG. 21 and stored in the database. Specifically, when the measured ambient temperature T1 becomes as indicated by a solid line by a chain line of FIG. 21, a corrected taper correction amount ϵ1 is obtained as indicated by a chain line of FIG. 21. A correction value of the taper correction amount is calculated in accordance with the unit temperature difference. The calculated value is set as the correction coefficient. Alternatively, the correction coefficient may be obtained from a test work of a workpiece.

TABLE 1

| Workpiece data | | | | | Grind condition data | | Target value of taper |
|---|---|---|---|---|---|---|---|
| Kind of workpiece | Length (mm) | Weight (kg) | Material | Hardness | Rotational speed (rpm) | Feeding speed of grinding wheel (mm/min.) | correction amount (μm) |
| Crank shaft | 300 | 10 | S53C | RB90 | 60 | 1.1 | −6 |
| Crank shaft | 300 | 10 | S53C | 100 | 70 | 1.2 | −4 |
| Crank shaft | 300 | 10 | FCD70 | RB90 | 55 | 0.9 | −8 |
| Crank shaft | 300 | 10 | FCD70 | 100 | 65 | 0.8 | −4 |
| Crank shaft | 300 | 12 | S53C | RB90 | 60 | 1.1 | −4 |
| Crank shaft | 300 | 12 | S53C | 100 | 70 | 1.2 | −2 |
| Crank shaft | 300 | 12 | FCD70 | RB90 | 55 | 0.9 | −4 |
| Crank shaft | 300 | 12 | FCD70 | 100 | 65 | 0.8 | 0 |
| Crank shaft | 300 | 14 | S53C | RB90 | 55 | 1.3 | −2 |
| Crank shaft | 300 | 14 | S53C | 100 | 65 | 1.4 | 0 |
| Crank shaft | 300 | 14 | FCD70 | RB90 | 50 | 1.1 | 0 |
| Crank shaft | 300 | 14 | FCD70 | 100 | 60 | 1.0 | +4 |

Figure 16A:
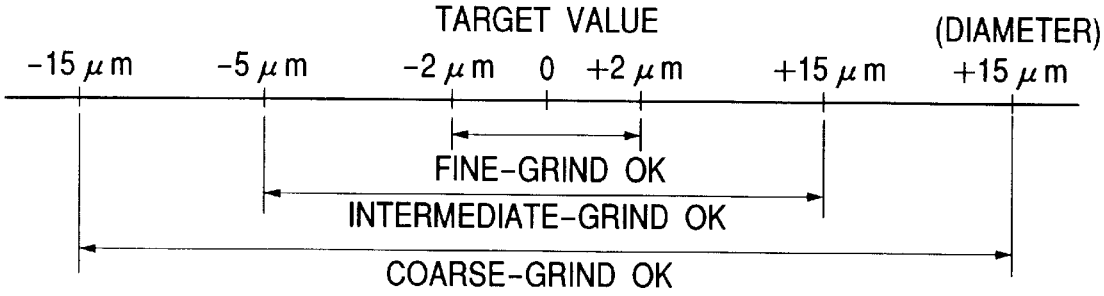
FIGS. 16A and 16B are diagrams showing allowable ranges of the taper correction in coarse grinding, intermediate grinding, and fine grinding of a workpiece.
Figure 16B:
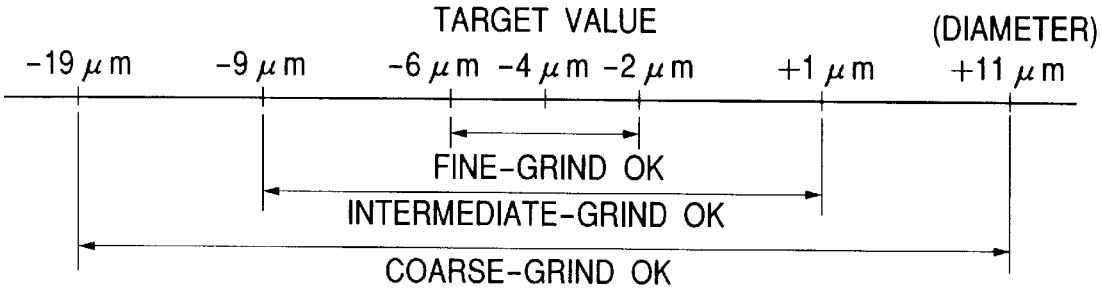
Figure 17:
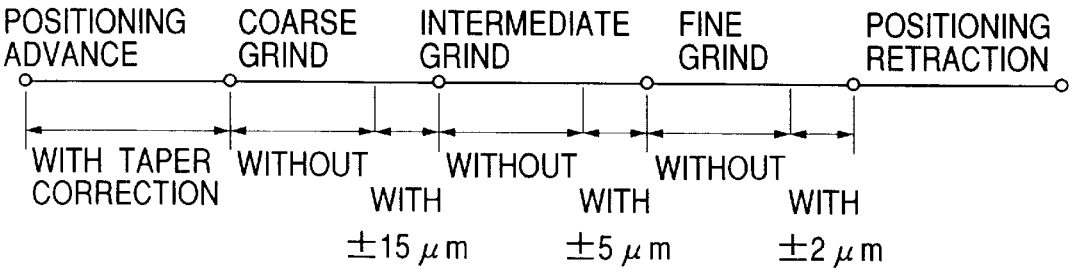
FIG. 17 is a diagram showing a timing of the taper correction in coarse grinding, intermediate grinding, and fine grinding of a workpiece.

Therefore, the database is checked to see whether a data of a workpiece that is identical in kind and specification with a workpiece which is to be newly ground exists in the database or not. If such a data exists, the target value of the outer diameter difference δ of a workpiece in the workpiece data is set as the target value in step S34 of the above-described flowchart of FIG. 15. In the database shown in Table 1, the target value is within the range of −8 μm to +4 μm. When the target value "−4 μm" is retrieved from the values and then set, for example, the allowable ranges of the taper correction amounts ϵ of coarse grinding, intermediate grinding, and fine grinding are set with centered at the target value "−4 μm" as "−19 μm to +11 μm," "−9 μm to +1 μm," and "−6 μm to −2 μm" as shown in FIG. 16B. In a workpiece which is ground in this way, there is no taper after the workpiece is unloaded from the grinding machine and at ordinary temperature.

Figure 18:
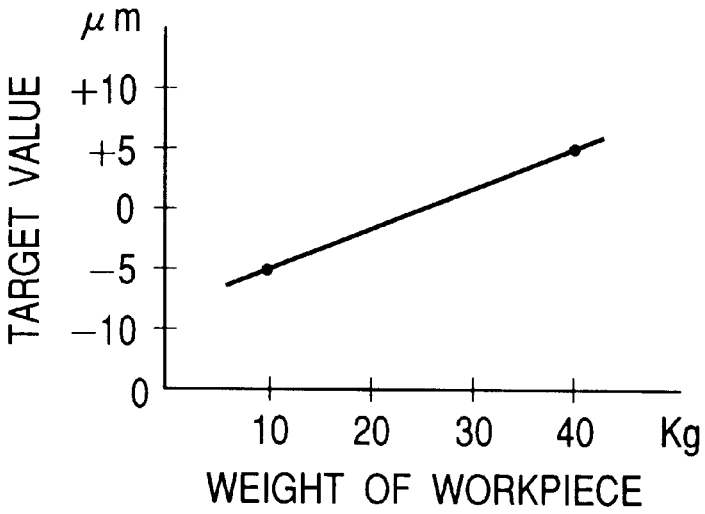
FIG. 18 is a graph showing relationships between the weight of a workpiece and a target value.
Figure 19:
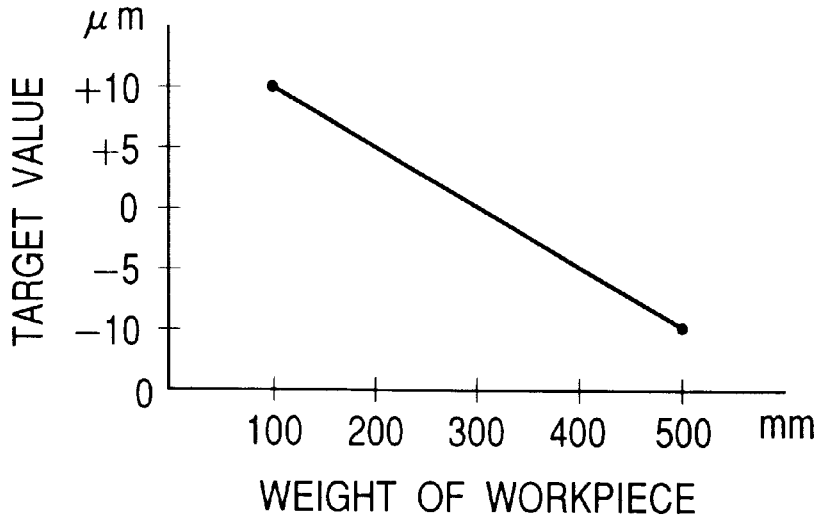
FIG. 19 is a graph showing relationships between the length of a workpiece and a target value.

When there exist only data of similar contents, the target value is calculated in the following manner. As shown in FIG. 18, a trend graph of the weight of a workpiece and a target value is previously prepared, or, as shown in FIG. 19, a trend graph of the length of a workpiece and a target value is previously prepared. The target value is calculated from the graph.

When a workpiece is to be newly worked, the ambient temperature such as the room temperature and the temperature in the vicinity of the grinding wheel spindle is measured by a temperature detector. When the detected temperature is different from the temperatures recorded in the database, the taper correction amount ϵ is corrected on the basis of the correction coefficient.

As described above, in the third taper correction method, when a workpiece is to be newly worked, the ambient temperature is detected, and, when the detected temperature is different from the temperatures recorded in the database, the correction corresponding to the temperature difference is performed. Therefore, it is possible to obtain the taper correction amount ϵ which is more adequate.

The invention is not restricted to the configurations of the above-described embodiments, and may be embodied with modifying the components in the following manners.

(1) In the embodiment, a large number of various data which are sampled in an initial stage of an operation of the grinding machine for first to n-th works are recorded in the database. Alternatively, irrespective of the number of grinding works, it may be detected whether a data corresponding to that of a workpiece which is to be newly worked is stored in the database or not, and it may be retrieved whether there is a temperature during a grinding work which is equal to or similar to the ambient temperatures stored in the database or not. The work of grinding a workpiece may be performed on the basis of the retrieved taper correction amount $\epsilon$ or the taper correction amount $\epsilon$ which is corrected by the temperature correction coefficient.

Also in this case, an adequate taper correction amount $\epsilon$ can be retrieved or calculated on the basis of variation of the taper correction amount $\epsilon$ due to temperature variation in an initial stage of an operation of the grinding machine, and hence it is possible to attain effects which are substantially identical with those of the first taper correction method.

(2) In the embodiment described above, the first to fifth grinding wheels 131 to 135 are used. Alternatively, only one grinding wheel may be used.

(3) In the embodiment described above, the rest devices are mounted at three places, respectively. Alternatively, only one rest device may be mounted at a center place.

(4) With respect to the control of the rest devices 121*a* to 121*c*, data which are previously set in accordance with the kind of a workpiece, namely, the advance position, the end position of coarse grinding, the end position of intermediate grinding, the end position of fine grinding, and the torques of the servomotors 122 to 124 and 122*a* to 24*a* of the rest devices, i.e., an adequate current value which is proportional to the pressing force on the workpiece may be stored as a control pattern as a database in the RAM 153. A control pattern of the rest devices corresponding to a workpiece which is to be newly worked is retrieved from the database, and the operation of the rest devices may be then controlled.

In this case, the accuracy of the roundness and straightness of a workpiece can be further improved.

As described above, according to the invention, the eccentric shaft device allows the grinding wheel to swing about the round shaft which is in parallel with the direction of the grinding wheel spindle, and hence the grinding wheel bearing pedestal support which supports the grinding wheel spindle to which a grinding wheel is attached produces only a small resistance to the swinging. Since the grinding wheel bearing pedestal support is displaced by the eccentric shaft device, the distance between the workpiece and the grinding wheel spindle can be accurately adjusted by the bearing on the side of the one end of the grinding wheel spindle.

The eccentric shaft device swings the grinding wheel bearing pedestal support by means of the eccentric shaft and the spring member opposing the displacement movement caused by the eccentric shaft. Therefore, the grinding wheel spindle can be accurately displaced without producing backlash or creep. The eccentric shaft device may be driven by a servomotor via a reduction gear. In this case, since a reduction gear which performs power transmission having no backlash is conventional technical means, a taper correcting apparatus for a grinding machine which is automated can be obtained by using a servomotor.

The eccentric shaft device presses the abutting portion on the side of the grinding wheel bearing pedestal support by means of vertical movement of the ring which is rotatably fitted onto the outer circumference of the eccentric shaft and which is restrained by a pin from rotating. Therefore, the outer circumference of the rotating eccentric shaft dose not slide with respect to the abutting portion, and hence the movement can be correctly transmitted. Furthermore, the durability is enhanced.

Since there is a bearing gap between the bearing and the grinding wheel spindle, the tilting of the grinding wheel spindle is enabled in the grinding wheel bearing by a simple configuration while maintaining the support rigidity.

Furthermore, the invention attain an excellent effect that a taper of a workpiece is rapidly corrected and the efficiency of grinding of a workpiece is improved.

Still further, in addition to the effect of the invention mentioned above, it is possible to attain an effect that the function of a rest device for supporting the ground surface of a workpiece can be optimized so as to further improve accuracies of a workpiece such as the roundness and the straightness.

Yet further, in addition to the effect of the invention described above, it is possible to attain an effect that the taper accuracy of a workpiece is improved.

What is claimed is:

1. A taper correcting apparatus for a grinding machine comprising:

workpiece supporting means for supporting a workpiece in parallel with a grinding wheel spindle;

a cutting and feeding device which moves back and forth a cylindrical grinding wheel with respect to said workpiece;

a wheel slide which is attached to a bed so as to be movable back and forth with respect to said workpiece;

a pair of grinding wheel bearing pedestals which rotatably support ends of said grinding wheel spindle via bearings with respect to said wheel slide, respectively;

a first grinding wheel bearing pedestal support which is fixed to said wheel slide, and which clampingly supports one of said grinding wheel bearing pedestals;

a second grinding wheel bearing pedestal support which is attached so as to be rotatable about a round shaft, and which clampingly supports another one of said grinding wheel bearing pedestals, said round shaft being attached below said grinding wheel spindle to said wheel slide in parallel with a center line of said workpiece;

a pressurring device which presses said second grinding wheel bearing pedestal support to rotate said second grinding wheel bearing pedestal support about said round shaft, thereby changing a distance between a center of said grinding wheel spindle and a center of said workpiece; and controlling means for controlling a pressing amount of said pressurring device, so that parallelism between said center line of said workpiece and a center line of said grinding wheel spindle is corrected.

2. The taper correcting apparatus for a grinding machine according to claim 1, wherein said pressurring device is an eccentric shaft device comprising: an eccentric shaft which is coupled to an output portion of a reduction gear with setting a center of said eccentric shaft to be eccentric, an input shaft of said reduction gear being coupled to a servomotor; a ring which is rotatably fitted onto an outer circumference of said eccentric shaft; an engaging hole which is formed in an outer circumference of said ring; a bracket portion which is disposed on said second grinding wheel bearing pedestal support, and which has an abutting portion that is to abut against the outer circumference of said ring, said bracket portion elongating in a lateral direction with respect to a line connecting a center of said round shaft and a center of a grinding wheel bearing; an engaging pin which protrudes from said abutting portion, and which is engaged with said engaging hole in the outer circumference of said ring; and a pressing member which passes through said bracket portion via a spring member to be fixed to said wheel slide, and which presses said bracket portion by means of said spring member so that said abutting portion of said bracket portion is always pressingly contacted with the outer circumference of said ring.

3. The taper correcting apparatus for a grinding machine according to claim 1 or 2, wherein said bearings have a bearing gap which allows said grinding wheel spindle to be tilted in a predetermined range.

4. A method of correcting a taper in a grinding machine in which a grinding wheel disposed on a wheel spindle stock moves back and forth in a direction perpendicular to a rotation axis of a workpiece which is grasped at both ends by a workpiece supporting mechanism, while making the rotation axis of said workpiece substantially parallel with a rotation axis of said grinding wheel, and an inclination of the rotation axis of said grinding wheel with respect to the rotation axis of said workpiece is corrected on the basis of outer diameters of ground surfaces of end portions of said workpiece, said outer diameters being measured by at least two sizing devices during a work of grinding said workpiece, thereby reducing a taper of a ground surface of said workpiece to "zero," said method comprising the steps of:

increasing or decreasing a taper correction amount required for grinding of said workpiece by means of said grinding wheel on the basis of a taper correction amount retrieved from a database which is previously stored;

then, starting the work of grinding said workpiece; and correcting the inclination of the rotation axis of said grinding wheel on the basis of outer diameters, measured by said sizing device, of the ground surfaces of the end portions of said workpiece, so as to reduce a taper of the ground surface of said workpiece to "zero."

5. The method of correcting a taper in a grinding machine according to claim 4, wherein said method further comprising the steps of:

(a) performing a test grinding work on plural workpieces, and storing amounts of taper correction on ground surfaces of said workpieces, together with workpiece data including kinds and sizes of said workpieces, and grind condition data of the test grinding works, as said database;

(b) retrieving grind condition data corresponding to workpiece data of a workpiece which is to be newly ground, from said database, and setting a taper correction amount which is stored in correspondence with the retrieved data, as a taper correction amount of said workpiece which is to be newly ground; and (c), during a period when said grinding wheel is moved from a standby position to be contacted with said workpiece and said grinding work is started, adjusting the inclination of the rotation axis of said grinding wheel to a predetermined value, by using said taper correction amount which is set in said step (b).

6. The method of correcting a taper in a grinding machine according to claim 5, wherein, in said step (a), the test grinding work is performed on plural workpieces in an initial stage of operation of a start of a grinding work in which a taper correction amount of a ground surface of a workpiece is relatively large, and, in said step (b), the retrieval of grind condition data corresponding to workpiece data of a workpiece which is to be newly ground is performed in an initial stage of operation of said grinding machine for a next work.

7. The method of correcting a taper in a grinding machine according to claim 6, wherein, following to the adjustment of the inclination of the rotation axis of said grinding wheel, starting points of support of a workpiece of plural rest devices which oppose pressing forces of said plural grinding wheels acting on plural ground surfaces of said workpiece are adjusted.

8. The method of correcting a taper in a grinding machine according to claim 6, wherein, following to the adjustment of the inclination of the rotation axis of said grinding wheel, pressing forces on a ground surface of a workpiece and exerted by plural rest devices which oppose pressing forces of said plural grinding wheels acting on the ground surface of said workpiece are adjusted.

9. The method of correcting a taper in a grinding machine according to any one of claims 6 to 8, wherein, in said step (a), on the basis of plural workpiece data and taper correction amounts corresponding to the workpiece data, calculation data for calculating a taper correction amount of a workpiece which similarly corresponds to the workpiece data are stored in said database, and, in said step (b), when there is no workpiece data of said workpiece which is to be newly ground, a taper correction amount of said workpiece which is to be newly ground is calculated on the basis of said calculation data and then set.

10. The method of correcting a taper in a grinding machine according to any one of claims 6 to 8, wherein, in said step (a), a number of grinding works is stored as said database, and, in said step (b), a taper correction amount of a number of works which correspond to a number of grinding works of said workpiece which is to be newly ground is retrieved from said database, and the retrieved taper correction amount is set as a taper correction amount of said workpiece which is to be newly ground.

11. The method of correcting a taper in a grinding machine according to any one of claims 6 to 8, wherein ambient temperatures during works of grinding plural workpieces of the same kind are sampled, a correction coefficient of a taper correction amount in the case of a temperature change is calculated for plural workpieces of the same kind and then stored in said database, and, when a taper correction amount of said workpiece which is to be newly ground is to be set, an ambient temperature during a grinding work of said workpiece which is to be newly ground is compared with said stored ambient temperature and a taper correction amount of said workpiece is correctively calculated with using said correction value at the temperature.

12. The method of correcting a taper in a grinding machine according to any one of claims 6 to 8, wherein said taper correction value of a workpiece during a grinding work is stored in said database with previously performing a test grinding work for each kind of workpieces, so that a difference between outer diameters of ground surfaces of end portions of a workpiece after end of a grinding work and at ordinary temperature becomes "zero," a taper correction value in a grinding work corresponding to a workpiece which is to be newly ground is retrieved from said database, and said test grinding work in said step (a) is performed on the basis of the taper correction value.

13. The method of correcting a taper in a grinding machine according to claim 12, wherein, in place of the operation of performing said test grinding work in said step (a) on the basis of the taper correction value, a taper correction amount of said workpiece is correctively calculated on the basis of the taper correction value.

14. The method of correcting a taper in a grinding machine according to claim 12, wherein allowable ranges of a taper correction amount for each of steps of coarse grinding, intermediate grinding, and fine grinding are reduced stepwise around the taper correction value of a workpiece as a center.

15. The method of correcting a taper in a grinding machine according to claim 14, wherein, during each of the steps of coarse grinding, intermediate grinding, and fine grinding, a taper correction is not performed in an initial stage, and a taper correction is performed in a final stage.

16. A taper correcting apparatus for a grinding machine comprising:

a work supporting mechanism which rotates a workpiece while grasping both ends of said workpiece by a spindle on a head stock and a tail stock disposed on a work table;

a wheel spindle stock having a grinding wheel which is rotatingly contacted with a ground surface of said workpiece to grind the ground surface;

inclination adjusting means, disposed between said wheel spindle stock and said grinding wheel, for adjusting an inclination of a rotation axis of said grinding wheel with respect to a rotation axis of said workpiece in accordance with a taper correction amount of an outer circumference of said workpiece;

wheel spindle stock driving means for moving back and forth said wheel spindle stock together with said grinding wheel with respect to said workpiece;

at least two sizing devices which measure outer diameters of ground surfaces of end portions of said workpiece;

storage means for storing, as a database, workpiece data including kinds, lengths, weights, materials, and hardnesses of plural workpieces, grind condition data including rotational speeds and feeding speeds of said grinding wheel and corresponding to said workpiece data, and taper correction amounts of outer circumferential faces of said workpieces and corresponding to said workpiece data and said grind condition data, said workpiece data, said grind condition data, and said taper correction amounts being obtained as a result of grinding said plural workpieces by said grinding machine;

retrieving means for retrieving a workpiece data, a grind condition data, and a taper correction amount corresponding to a workpiece which is to be newly ground, from said database; and controlling means for controlling operations of said inclination adjusting means and said wheel spindle stock driving means on the basis of said grind condition data and said taper correction amount.

17. A taper correcting apparatus for a grinding machine according to claim 16, wherein said storage means stores workpiece data, grind condition data, and taper correction amounts of ground surfaces of plural workpieces and corresponding to said workpiece data and said grind condition data, said grind condition data, and said taper correction amounts being obtained as result of grinding said workpieces in an initial stage of an operation of said grinding machine, and said retrieving means retrieves a workpiece data, a grind condition data, and a taper correction amount corresponding to a workpiece which is to be newly ground, from said database, in an initial stage of an operation of said grinding machine for a next work.

18. The taper correcting apparatus for a grinding machine according to claim 17, wherein said grinding machine further comprises: plural rest devices which support a ground surface of said workpiece when said workpiece is ground by said grinding wheel; and rest device driving means for moving said rest devices in accordance with a grinding amount of said workpiece, and, following to a change of the taper correction amount, said controlling means adjusts advance positions of said rest devices, and adjusts pressing forces of said rest devices exerted on said workpiece.

19. The taper correcting apparatus for a grinding machine according to claim 17 or 18, wherein said grinding machine comprises number detecting means for detecting a number of works of grinding a workpiece, and, on the basis of number data from said number detecting means, said retrieving means retrieves corresponding a grind condition data and a taper correction amount from said database.

20. The taper correcting apparatus for a grinding machine according to claim 19, wherein said grinding machine further comprises temperature detecting means for detecting a room temperature of an ambient, or a temperature of a vicinity of said wheel spindle stock of said grinding machine, and said controlling means comprises means for calculating a taper correction amount on the basis of temperature data from said temperature detecting means.

* * * * *